US008783810B2

(12) United States Patent
Yuda et al.

(10) Patent No.: US 8,783,810 B2
(45) Date of Patent: Jul. 22, 2014

(54) DOT FORMATION POSITIONING DEVICE, RECORDING METHOD, SETTING METHOD, AND RECORDING PROGRAM

(75) Inventors: Tomohiro Yuda, Minowa-machi (JP); Masato Mitsuhashi, Hara-mura (JP); Sumito Anzai, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 236 days.

(21) Appl. No.: 13/411,092

(22) Filed: Mar. 2, 2012

(65) Prior Publication Data

US 2012/0223994 A1 Sep. 6, 2012

(30) Foreign Application Priority Data

Mar. 3, 2011 (JP) ..... 2011-046072

(51) Int. Cl.
*B41J 29/38* (2006.01)
*B41J 19/14* (2006.01)
*B41J 2/21* (2006.01)

(52) U.S. Cl.
CPC ..... *B41J 19/142* (2013.01); *B41J 2/2132* (2013.01)
USPC ..... 347/14

(58) Field of Classification Search
CPC ..... B41J 9/142; B41J 2/2132
USPC ..... 347/14, 19
See application file for complete search history.

(56) References Cited

U.S. PATENT DOCUMENTS

2003/0122890 A1 * 7/2003 Shimada et al. ..... 347/19
2004/0207675 A1 * 10/2004 Otsuki ..... 347/19

FOREIGN PATENT DOCUMENTS

JP 05-254121 A 10/1993

* cited by examiner

*Primary Examiner* — Laura Martin
*Assistant Examiner* — Carlos A Martinez
(74) *Attorney, Agent, or Firm* — Global IP Counselors, LLP

(57) ABSTRACT

To improve positioning accuracy in a direction of relative movement of dots which are formed by a fluid ejection device in which a plurality of nozzle groups contained in the direction of the relative movement of the head section contain a plurality of nozzles in the direction of the relative movement, an ejection timing is set for adjusting in a direction of the relative movement the positions of dots formed by each of nozzle groups. A distribution of adjustment pixels is set for adjusting in the direction of the relative movement the positions of dots formed by each of nozzles. A fluid is ejected in accordance with raster data generated on the basis of a distribution of the adjustment pixels set by an adjustment pixel setting unit, on the basis of ejection timing set by a nozzle group timing setting unit.

9 Claims, 18 Drawing Sheets

Fig. 6A

TIMING ADJUSTMENT DATA DA8

| NOZZLE GROUP | #1 | #2 | #3 | #4 | #5 |
|---|---|---|---|---|---|
| DURING OUTBOUND MOVEMENT | 0 | -4 | 11 | -12 | -1 |
| DURING RETURN MOVEMENT | 0 | -2 | 10 | -8 | -4 |
| | M,C | Lk, Y | K, K | Y, Lk | C, M |

Fig. 6B

DISTRIBUTION DATA DA9

| NOZZLE GROUP | #1B | #2B | #3B | #4A | #5A |
|---|---|---|---|---|---|
| DURING OUTBOUND MOVEMENT | 0 | 1 | -1 | 0 | 0 |
| DURING RETURN MOVEMENT | 0 | -2 | 0 | 0 | -1 |
| | C | Y | K | Y | C |

Fig. 6C

DISTRIBUTION DATA DA9

| NOZZLE GROUP | #1A | #1B | #2A | #2B | #3A | #3B | #4A | #4B | #5A | #5B |
|---|---|---|---|---|---|---|---|---|---|---|
| DURING OUTBOUND MOVEMENT | 0 | 0 | -1 | 0 | 0 | 0 | 1 | -1 | 0 | 0 |
| DURING RETURN MOVEMENT | 0 | 0 | 0 | 0 | -1 | 0 | 1 | 0 | -1 | 0 |
| | M | C | Lk | Y | K | K | Y | Lk | C | M |

REFERENCE PATTERN

APPROPRIATE PATTERN

MINUS-SIDE PATTERN

PLUS-SIDE PATTERN

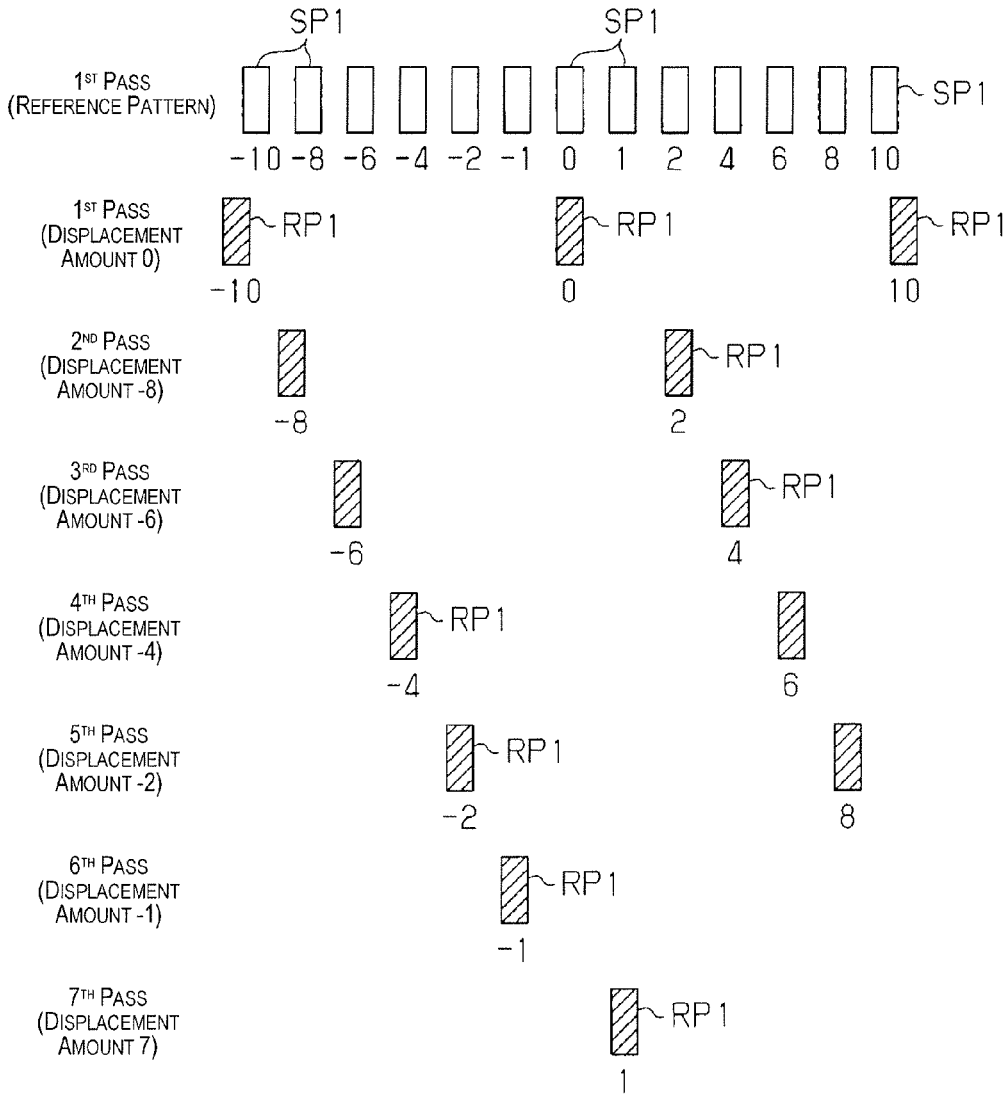
Fig. 11
Fig. 12
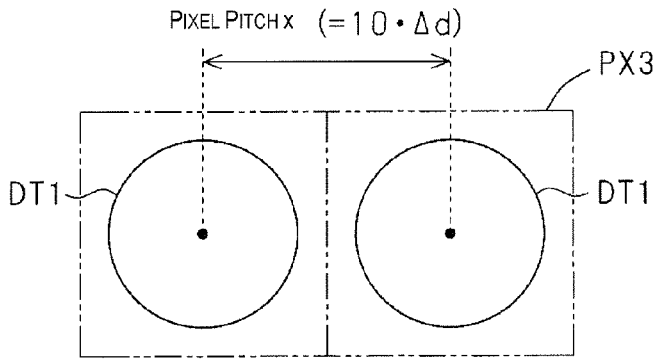

DOT FORMATION POSITIONING DEVICE, RECORDING METHOD, SETTING METHOD, AND RECORDING PROGRAM

CROSS-REFERENCE TO RELATED APPLICATIONS

This application claims priority to Japanese Patent Application No. 2011-046072 filed on Mar. 3, 2011. The entire disclosures of Japanese Patent Application No. 2011-046072 is hereby incorporated herein by reference.

BACKGROUND

1. Technical Field

The present invention relates to a technique for a fluid ejection device in which a plurality of nozzle groups demarcated in a direction of relative movement of a head section respectively have nozzles at respectively different positions in the direction of relative movement.

2. Background Technology

One known fluid ejection device of the aforedescribed type is, for example, a recording apparatus adapted to eject ink from a plurality of nozzles while bringing about relative movement between a recording medium and a head furnished with the plurality of nozzles. A recording apparatus in which respective nozzle rows are furnished at different positions in a direction of relative movement of the head section (for example, the main scanning direction) is designed to eject ink from the plurality of nozzle rows in alignment with positions in the direction of relative movement when forming dots at those positions. Patent Citation 1 discloses an electrostatically controlled inkjet recording apparatus. In this recording apparatus, a fixed platen is furnished with a pressure detector for detecting pressure of air flows from air discharge openings of black, cyan, magenta, and yellow inkjet heads. Distances between adjacent inkjet heads are measured from intervals between detection outputs by the pressure detector, while controlling the amount of ejection delay among the inkjet heads.

Japanese Patent Application Publication No. 5-254121 (Patent Citation 1) is an example of the related art.

SUMMARY

Problems to Be Solved by the Invention

However, the aforedescribed control of the amount of ejection delay is an adjustment methodology limited to the structure of an electrostatically controlled inkjet recording apparatus, and lacks versatility. Also, for fluid ejection devices or the like in which a plurality of nozzle groups demarcated in a direction of relative movement of a head respectively have nozzles at respectively different positions in the direction of relative movement, this would lead to improved picture quality of images formed by the fluid ejection devices or the like when positioning accuracy in relation to the direction of relative movement could be improved for the dots which are formed on the recording medium.

With the foregoing in view, it is an advantage of the invention to improve positioning accuracy in a direction of relative movement of dots which are formed by a fluid ejection device in which a plurality of nozzle groups contained in the direction of relative movement of the head section contain a plurality of nozzles in the direction of relative movement.

Means Used to Solve the Above-Mentioned Problems

In order to attain the aforedescribed advantage, the invention in a first aspect provides a dot formation positioning device for a fluid ejection device having a relative movement unit for bringing about relative movement between a recording medium and a head furnished with a plurality of nozzles, and adapted to eject a fluid from the plurality of nozzles in accordance with raster data; wherein the plurality of nozzles includes a plurality of nozzle groups in the direction of relative movement; the nozzle groups includes a plurality of nozzles in the direction of relative movement; the device is provided with a nozzle group timing setting unit for setting an ejection timing for dots formed by each of the nozzle groups to undergo position adjustment in the direction of relative movement; an adjustment pixel setting unit for setting a distribution of adjustment pixels for dots formed by each of the nozzle groups to undergo position adjustment in the direction of relative movement; and timing control unit for performing control to eject fluid in accordance with the raster data generated on the basis of the distribution of the adjustment pixels set by the adjustment pixel setting unit, on the basis of the ejection timing set by the nozzle group timing setting unit.

Specifically, at the nozzle group unit level, position displacement of dots of ejected fluid is compensated through ejection timing set by the nozzle group timing setting unit. For the nozzles constituting the nozzle groups, position displacement of dots are compensated through a distribution of adjustment pixels set by the adjustment pixel setting unit.

Thus, for the nozzles constituting the nozzle groups, even if position displacement of dots cannot be adequately compensated through ejection timing that is variable in nozzle group-equivalent units, position displacement of dots can be compensated through a distribution of adjustment pixels constituting the raster data. In cases in which ejection timing cannot be adequately adjusted in nozzle group-equivalent units, even if good positioning accuracy is attained for a first nozzle at a given position in the direction of relative movement within a nozzle group, a second nozzle at a different position in the direction of relative movement within the same nozzle group can have lower positioning accuracy of the dot than does the first nozzle. According to the invention, good positioning accuracy of the dot for the second nozzle can be attained through a distribution of adjustment pixels constituting the raster data.

As a consequence, according to the invention, in a fluid ejection device in which a plurality of nozzle groups included in the direction of relative movement of the head section include a plurality of nozzles in the direction of relative movement, the positioning accuracy of dots formed thereby can be improved in the direction of relative movement.

Here, relative movement between the recording medium and a head refers to movement of at least one of the recording medium and the head section, and can include movement of the head section relative to the recording medium, movement of the recording medium relative to the head section, or movement of both the head section and the recording medium. The aforedescribed nozzle groups can include nozzle groups formed in separate ejection heads into which the head section has been divided; nozzle groups formed in demarcations of an undivided head which has been demarcated; or the like. The nozzles furnished to the nozzle groups can include nozzle rows lined up at different positions in the direction of relative movement and along a direction intersecting the direction of relative movement; single nozzles; or the like. The aforedescribed fluid can be any one that can form dots on the recording medium, including liquids, powders, and the like, and more specifically including ink, toner, or the like. The aforedescribed dots are formed on the recording medium by ejection of fluid, and can include fluid deposited onto the recording medium, asperity formed on the recording medium, or the like.

The aforedescribed raster data can be furnished with primary pixel data representing dot formation states on the recording medium, and with adjustment pixel data representing adjustment pixels for adjusting within the raster data positions which correspond to the direction of relative movement of the primary pixel data. The primary pixel data includes data representing whether to form a dot on each pixel, data representing in terms of a tone value the size of the dot on each pixel, and the like. The adjustment pixel includes data to not form a dot on each pixel, data to form a colorless dot on each pixel, and the like.

The nozzle group timing setting unit includes a retaining unit for information representing the ejection timing, and unit for performing a process to set the ejection timing. The nozzle group timing setting unit can set an ejection timing in order to compensate for position displacement of dots formed by the nozzle groups, with respect to reference positions in the direction of relative movement. The reference positions can include positions in the direction of relative movement of dots formed by reference nozzles selected from among the plurality of nozzles; positions in the direction of relative movement unrelated to positions of dots formed by the plurality of nozzles, and the like. The adjustment pixel setting unit can set a distribution of the adjustment pixels in order to compensate for position displacement in the direction of relative movement of dots formed by the nozzles constituting the nozzle groups, at the set ejection timing. The compensation for position displacement includes not only complete elimination of position displacement between dots, but also reduced position displacement between dots. The adjustment pixel setting portion includes a retaining unit for information representing a distribution of adjustment pixels, unit for performing a process to set the distribution of adjustment pixels, and the like.

The smallest unit in which dot formation position is adjustable by the nozzle group timing setting unit can be smaller than the pitch of the pixels constituting the adjusted raster data, in the direction of relative movement. In so doing, the positioning accuracy of dots in the direction of relative movement can be finer than the pitch of pixels in the direction of relative movement. The nozzle group timing setting unit can set the ejection timing respectively for the outbound path and return path in the direction of relative movement. The adjustment pixel setting unit can set the adjustment pixel distributions respectively for the outbound path and return path in the direction of relative movement. In so doing, proper ejection timing and adjustment pixel distributions can be set respectively for the outbound path and return path of the head section.

The nozzle group timing setting unit can be provided with first adjustment pattern forming unit for forming a first adjustment pattern in order to adjust the ejection timing, and with timing setting reception unit for receiving the ejection timing setting. The adjustment pixel setting unit can be provided with second adjustment pattern forming unit for forming a second adjustment pattern in order to adjust the adjustment pixel distribution, and with distribution setting reception unit for receiving the adjustment pixel distribution. In so doing, position alignment of dots in the direction of relative movement can be performed easily.

Also, the nozzle group timing setting unit, when designating at least a portion of the nozzles in one nozzle group among the plurality of nozzle groups as first reference nozzles, and designating at least a portion of the nozzles in nozzle groups excluding the one nozzle group among the plurality of nozzle groups as first adjustment candidate nozzles, can eject fluid from the first adjustment candidate nozzles at an adjustment ejection timing which makes reference to a reference ejection timing of fluid from the first reference nozzles, to form a first adjustment pattern on the recording medium. The nozzle group timing setting unit can also receive an ejection timing setting that aligns the positions of dots formed by the first reference nozzles and the first adjustment candidate nozzles in the direction of relative movement. The adjustment pixel setting unit, when designating at least a portion of the nozzles in the first nozzle group or a portion of the nozzles in nozzle groups excluding the first nozzle group as second reference nozzles, while designating the others as second adjustment candidate nozzles, can eject fluid from the second adjustment candidate nozzles in alignment with an ejecting timing set in accordance with adjustment raster data in which the adjustment pixels are distributed in the direction of relative movement with reference to a reference distribution of the adjustment pixels for the second reference nozzles, to form a second adjustment pattern on the recording medium. The adjustment pixel setting unit can receive a distribution of the adjustment pixels that aligns positions of dots formed by the second reference nozzles and the second adjustment candidate nozzles in the direction of relative movement. Here, the adjustment ejection timing includes ejection timing shifted in stepwise fashion with reference to a reference ejection timing, and the like; and more simply includes ejection timing identical to the reference ejection timing, a single ejection timing shifted from the reference ejection timing, or the like. Alignment of dot positions includes not only bringing about complete congruence of dot positions, but also to bringing positions of dots formed by the adjustment candidate nozzles closer to the positions of dots formed by the reference nozzles. Distributions making reference to a reference distribution include distributions shifted in stepwise fashion with reference to the reference distribution, and the like; and more simply include a distribution identical to the reference distribution, a single distribution shifted from the reference distribution, and the like.

It is possible for the fluid ejection device to form dots on the recording medium in a plurality of dot formation modes relating to dot formation. The first adjustment pattern forming means can form the first adjustment pattern by a nozzle group for ejecting a fluid of a color according to the dot formation mode. In so doing, position alignment of dots in the direction of relative movement can be performed according to the dot formation mode. In cases in which an image is being formed on the recording medium, picture quality of the image can be improved.

Nozzles for ejecting fluid of the same color can be present in the first nozzle group and the second nozzle group among the plurality of nozzle groups. In so doing, positioning accuracy in the direction of relative movement of dots of the same color in the direction of relative movement can be improved. In cases in which an image is being formed on the recording medium, picture quality of the image can be improved.

The aspect discussed above is applicable to a fluid ejection device incorporating a dot formation positioning device; a printing control device; a printing device; a setting method provided, for example, with a step of setting nozzle group timing or a step of setting adjustment pixels; a recording method further provided with a timing control step; a printing control method; a printing method; a recording program for accomplishing by computer the functions, for example, of a function for setting nozzle group timing, a function for setting adjustment pixels, or a timing control function; a printing control program; a printing program; a medium recording these programs in computer-readable fashion; an adjustment pattern; a medium recording an adjustment pattern; and the like.

BRIEF DESCRIPTION OF THE DRAWINGS

Referring now to the attached drawings which form a part of this original disclosure:

FIG. 6 A is a view schematically exemplifying a structure of timing adjustment data DA8, and B and C are views schematically exemplifying a structure of distribution data DA9;

FIG. 11 is a view schematically exemplifying a chart recording procedure;

FIG. 12 is view schematically exemplifying recorded pixels;

DETAILED DESCRIPTION OF EXEMPLARY EMBODIMENTS

(1) Overview of Dot Formation Positioning

Figure 1A:
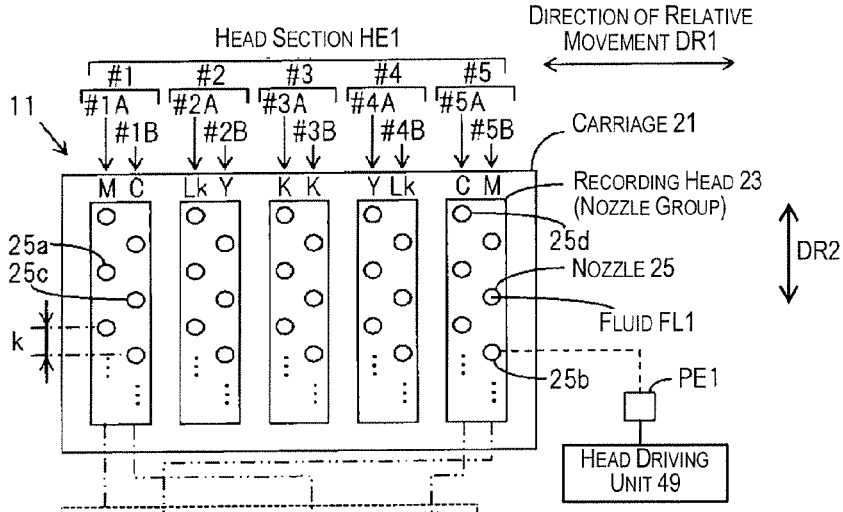
FIGS. 1A to 1D are views schematically exemplifying a concept of dot formation positioning.
Figure 1B:
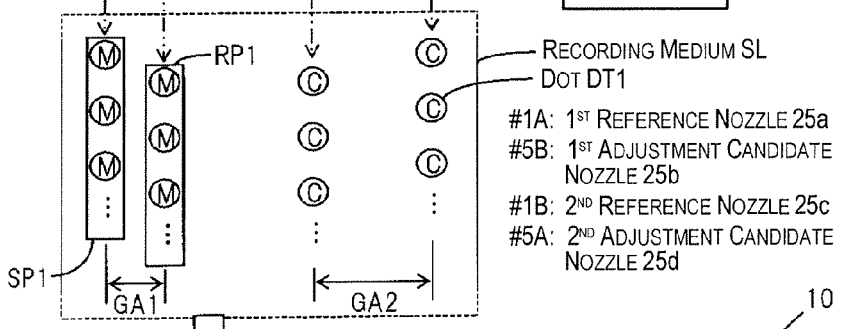
Figure 1C:
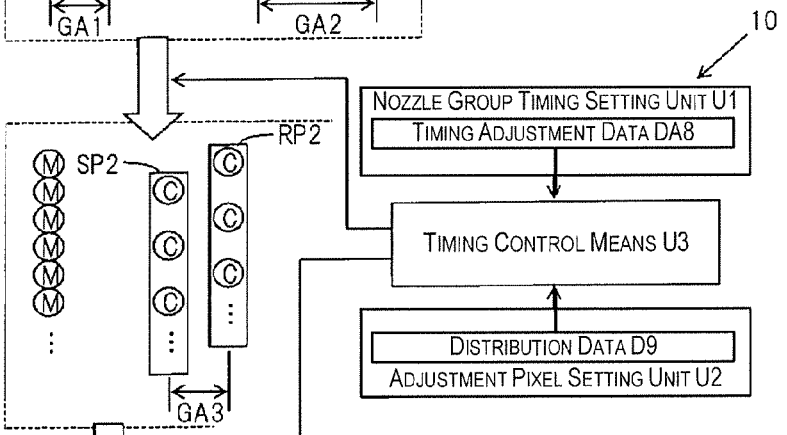
Figure 1D:
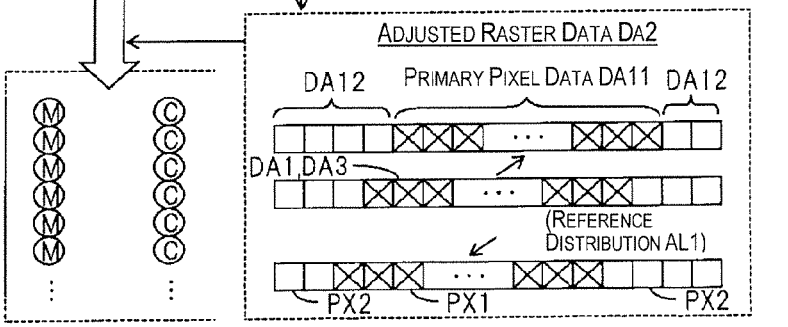

First, an overview of dot formation positioning according to an aspect of the invention is described with reference to FIGS. 1 A to D, etc. FIG. 1 A exemplifies the bottom surface of a carriage 21 furnished to a head section HE1. The head section HE1 is divided into a plurality of recording heads (nozzle groups) 23 in a direction of relative movement DR1, which is also the main scanning direction. In each recording head #H (H is an integer from 1 to 5), there are lined up in the main scanning direction (DR1) a plurality of nozzle rows in which a plurality of (e.g., 180) nozzles 25 line up in a sub-scanning direction (DR2) orthogonal to the main scanning direction. In each nozzle row #HA, #HB of the recording head #H, nozzles 25 for spraying (ejecting) a fluid FL1 such as ink or the like are arrayed at a predetermined pitch k in the sub-scanning direction (DR2). Consequently, in the fluid ejection device (11), the plurality of nozzles 25 are demarcated into a plurality of nozzle groups (23) with respect to the direction of relative movement DR1 of the head section HE1, the nozzle groups (23) respectively having nozzles (nozzle rows #HA, #HB) at respectively different positions in the direction of relative movement DR1.

One feature of the present technique is a combination of (A) adjustment of the ejection timing of ink at the recording head #H level (PTS adjustment), and (B) adjustment of dot formation position by nozzle rows #Hi included in a recording head #H, through shifting of raster data (pixel displacement).

The aforedescribed (A) "PTS adjustment" refers to adjustment of a print timing signal PTS, whereby ejection timing can be adjusted for each recording head #H, which is the unit of control of ink ejection timing. For example, where the printing timing signal PTS for a recording head #H targeted for adjustment is delayed with respect to a reference timing so that positions of dot formation by the recording head #H are brought into alignment with reference positions, the ink ejection timing of the recording head #H in question can be adjusted. As shall be apparent, the unit of adjustment of ink ejection timing is not limited to the recording head, the ejected matter is not limited to ink, nor is adjustment of ejection timing limited to adjustment of the print timing signal PTS.

The aforedescribed (B) "pixel displacement" refers to adjustment through shifting, in pixel-equivalent units, of data of primary pixels PX1 representing dot formation states in raster data in the main scanning direction, whereby raster data can be adjusted for each nozzle row #Hi included in a recording head #H. For example, by shifting primary pixels of the raster data of a nozzle row #Hi targeted for adjustment so that positions of dot formation by the nozzle row #Hi are brought into alignment with reference positions, positions of dot formation can be adjusted for each nozzle row #Hi not adequately compensated for by adjustment of ink ejection timing.

The plurality of nozzles 25 in the example of FIG. 1 A are split according to each color of the ejected fluid FL1. The nozzles 25 of each color are included in two or more nozzle groups (23) selected from the plurality of nozzle groups (23). Dots DT1 formed by nozzles 25 for ejecting fluid FL1 of the same color which are included in the two or more nozzle groups (23) line up in the sub-scanning direction (DR2). Specifically, magenta (M) nozzle rows #1A, #5B are disposed furthest outward of the nozzle rows lined up in the direction of relative movement DR1; cyan (C) nozzle rows #1B, #5A inward from these; light black (Lk) nozzle rows #2A, #4B inward from these; yellow (Y) nozzle rows #2B, #4A inward from these; and black (K) nozzle rows #3A, #3B furthest inward. For example, focusing on magenta (M), the recording head #1 constitutes a first nozzle group, and the recording head #5 constitutes a second nozzle group. As shall be apparent, the recording head #5 could constitute a first nozzle group, and the recording head #1 could constitute the second nozzle group instead. Focusing on cyan (C), either the recording head #1 or #5 constitutes a first nozzle group, with the other constituting a second nozzle group. Focusing on light black (Lk), either the recording head #2 or #4 constitutes a first nozzle group, with the other constituting a second nozzle group. By disposing the nozzles 25 in point-symmetric fashion with reference to the center of the head section HE1, the order in which the colors of the fluid FL1 are ejected will be the same during bidirectional printing (Bi-d printing), whereby printing is performed both during outbound movement and return movement of the carriage 21. In so doing, color irregularities of different colors during outbound movement versus during return movement are minimized, and high quality printing results are obtained.

Figure 4:
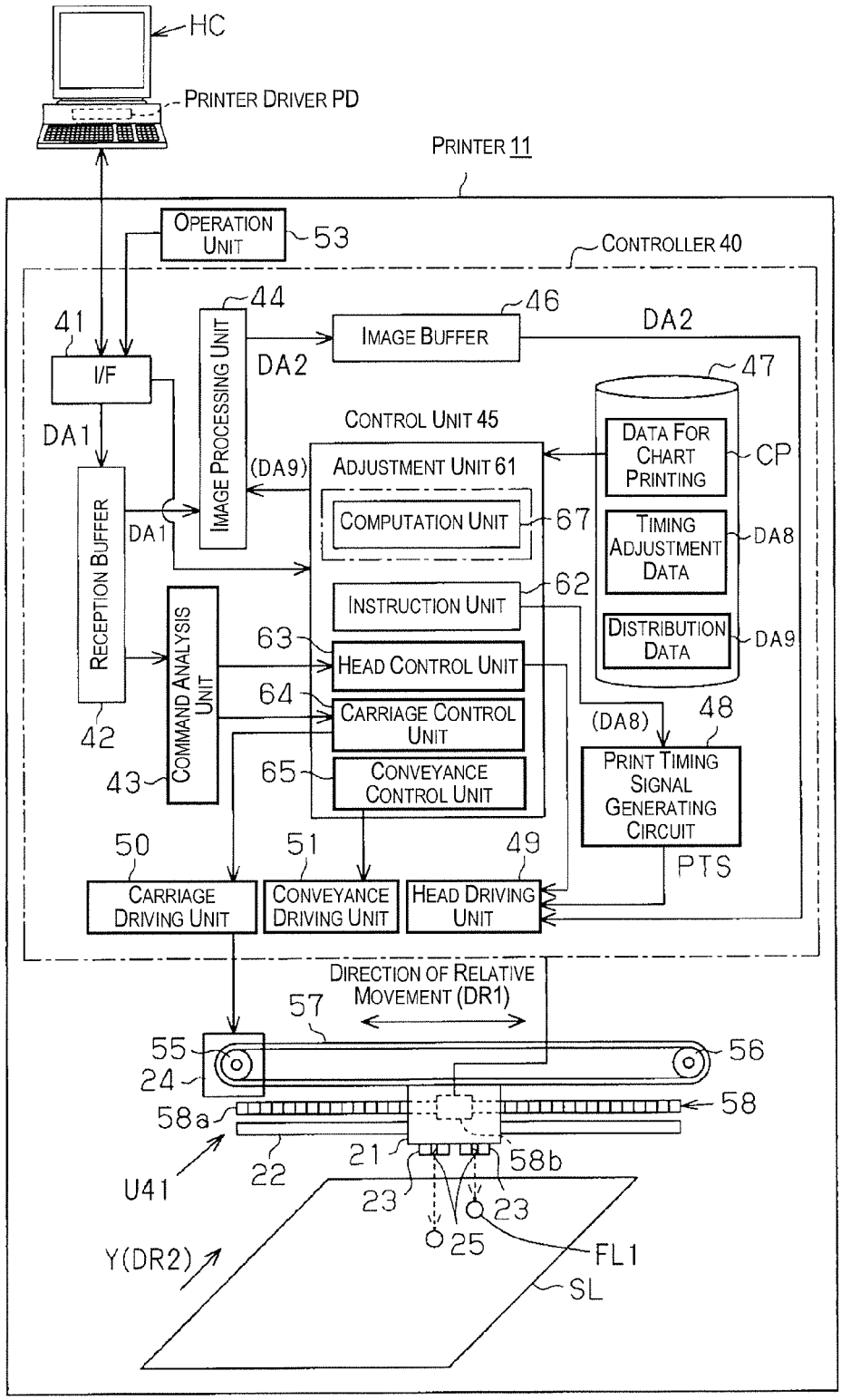
FIG. 4 is a block diagram exemplifying the configuration of the printer 11.

The carriage 21 is driven in reciprocating fashion in the main scanning direction by relative movement means U41 exemplified in FIG. 4. This relative movement means U41 brings about relative movement between the recording medium SL and the head section HE1 furnished with the plurality of nozzles 25. The fluid ejection device (11) ejects the fluid FL1 from the plurality of nozzles 25 according to raster data DA1 exemplified in FIG. 1 D and FIG. 5 A. The raster data DA1 is furnished with primary pixel data DA11 and adjustment pixel data DA12. The primary pixel data DA11 is data that represents for each pixel (PX1) a dot DT1 formation state on the recording medium SL. The adjustment pixel data DA12 is data representing adjustment pixels PX2 for position adjustment corresponding to the direction of relative movement DR1 of the primary pixel data DA11 in the raster data DA1.

As exemplified in FIG. 1 C, the dot formation positioning device 10 for the aforedescribed fluid ejection device (11) is provided with a nozzle group timing setting unit U1, an adjustment pixel setting unit U2, and timing control means U3. The dot formation positioning device 10 can be constituted as specific means realized through cooperation between software and hardware resources; or basically constituted as specific means realized through software loaded into a computer; or basically constituted as hardware resources, such as an ASIC (Application Specific IC) or other integrated circuit, or the like. The nozzle group timing setting unit U1 sets an ejection timing (timing adjustment data DA8) for the purpose of compensating for a position gap GA1 between dots DT1 formed by the recording heads 23, with respect to reference positions (first reference pattern SP1) in the direction of relative movement DR1. For each of the recording heads #H, the nozzle group timing setting unit U1 in the example of FIGS. 1 A and (c) sets ejection timing (DA8) for the purpose of compensating for the position gap GA1 in the direction of relative movement DR1, of dots DT1 formed by the nozzles 25 ejecting fluid FL1 of the same color, which are included in the two or more recording heads 23. The timing adjustment data DA8 corresponds to the setting for the aforedescribed "PTS adjustment."

The adjustment pixel setting unit U2 sets up a distribution (distribution data DA9) of adjustment pixels PX2 for the purpose of compensating for a position gap GA3 in the direction of relative movement DR1 of dots DT1 formed at the aforedescribed set ejection timing (DA8) by the nozzles 25 which constitute the recording heads 23. For each of the nozzle rows #HA, #HB, the adjustment pixel setting unit U2 in FIGS. 1 A to D sets a distribution (DA9) of adjustment pixels PX2 for the purpose of compensating for a position gap GA3 in the direction of relative movement DR1 of the dots DT1 formed by the nozzles 25 for ejecting fluid FL1 of the same color, which are included in the two or more recording heads 23. The distribution data DA9 corresponds to the setting data for the aforedescribed "pixel displacement." For the aforedescribed raster data DA1, the timing control means U3 generates adjusted raster data DA2 as data in which adjustment pixel data DA12 is represented by adjustment pixels PX2 in the distribution (DA9) that was set by the adjustment pixel setting unit U2. It also performs control of ejection of the fluid FL1 from the plurality of nozzles 25 according to the adjusted raster data DA2 in a manner coincident with the ejection timing (DA8) that was set by the nozzle group timing setting unit U1. Specifically, the adjustments corresponding to the aforedescribed "PTS adjustment" and "pixel displacement" are performed by the timing control means U3.

In recent years, fluid ejection devices have come to have quite high resolutions, such as 2880 dpi, 1440 dpi, 720 dpi, or the like. For this reason, the spacing between dots formed on the recording medium are very small, such as 8.8 μm, 18 μm, 35 μm, or the like. Consequently, it is desirable to improve the accuracy of dot formation position. Where there are a plurality of divided recording heads, the recording heads attached to the carriage can have slight variability in spacing in the main scanning direction, and errors can arise in the formation positions of the dots DT1. As shall be apparent, there is slight variability in spacing between nozzle rows within recording heads as well. Also, the recording heads attached to the carriage can be slightly tilted, and errors can arise in the formation positions of the dots DT1.

Here, as exemplified in FIG. 1 A, reference numerals 25*a*, 25*b*, 25*c*, and 25*d* respectively denote the aforedescribed first reference nozzle, the aforedescribed first adjustment candidate nozzle, the aforedescribed second reference nozzle, and the aforedescribed second adjustment candidate nozzle. The first reference nozzle(s) 25*a* is a nozzle(s) constituting at least a portion of those in one recording head (denoted as #Hs) among the plurality of recording heads #H. The first adjustment candidate nozzle(s) 25*b* is a nozzle(s) constituting at least a portion of those in one recording head (denoted as #Hr) among the plurality of recording heads #H, excluding the aforedescribed one recording head #Hs. Either at least a portion of the nozzles in the aforedescribed one recording head #Hs, or at least a portion of the nozzles in the aforedescribed recording head #Hr excluding the one recording head #Hs, are designated as the second reference nozzle(s) 25*c*, with the other being designated as the second adjustment candidate nozzle(s) 25*d*. In the example of FIG. 1 A, #1B is the row of the second reference nozzle 25*c*, and #5A is that of the second adjustment candidate nozzle 25*d*. However, #5A could be the row of the second reference nozzle 25*c*, and #1B that of the second adjustment candidate nozzle 25*d* instead.

Also, reference numerals SP1, RP1 of FIG. 1 B respectively exemplify the aforedescribed first reference pattern (reference position) and the aforedescribed first adjustment pattern. GA1 denotes a position gap in the direction of relative movement DR1 of the dots DT1 formed by the first reference nozzle 25*a* of #1A and the first adjustment candidate nozzle 25*b* of #5B; and GA2 denotes a position gap in the direction of relative movement DR1 of the dots DT1 formed by the second reference nozzle 25*c* of #1B and the second adjustment candidate nozzle 25*d* of #5A. As discussed previously, due to slight errors in spacing, characteristics, tilt, etc. of the heads, GA1 and GA2 can not always be the same.

In cases in which the ejection timing of the fluid FL1 can only by varied in recording head #H-equivalent units, the ejecting timing is set so as to compensate for the position gap GA1 between dots by the nozzle rows #1A and #5B as shown in FIG. 1 C. In this case, a position gap GA3 can arise between dots by the nozzle rows #1A and #5B. For example, where a position gap GA2 is compensated for only by the position gap GA1, logically, GA3=GA2−GA1, and as long as GA1 and GA2 differ, a position gap GA3 will arise between dots by the nozzle rows #1B and #5A. The aforedescribed compensation includes not only complete elimination of the position gap GA1 between dots, but also reduction of the position gap GA1 between dots. For example, in cases where the ejection timing can be adjusted in units of 8.8 μm corresponding to 2880 dpi, extremely slight errors of ±4.4 μm can arise. However, the position gap GA3 between dots by the nozzle rows #1A and #5, which cannot be brought into alignment with the ejection timing, can be larger than very slight errors of +4.4 p.m.

Thus, at ejection timing for bringing into alignment the positions of formation of dots by the first reference nozzle 25*a* and by the first adjustment candidate nozzle 25*b*, the distribution of adjustment pixels PX2 is varied in such a way as to compensate for the position gap GA3 in the direction of relative movement DR1 of dots formed by the second reference nozzle 25*c* and the second adjustment candidate nozzle 25*d*. The reference numerals SP2, RP2 of FIG. 1 C respectively exemplify the aforedescribed second reference pattern and the aforedescribed second adjustment pattern.

Compensation through the adjustment pixel PX2 distribution includes not only complete elimination of the position gap GA3 between dots, but also reduction of the position gap GA3 between dots. For example, while greater than the units of 8.8 μm corresponding to 2880 dpi, in cases where the ejection timing can be adjusted in units of 35 μm corresponding to 720 dpi, errors of ±17.5 μm can arise. However, in cases in which the position gap GA3 exceeds ±17.5 μm, dot position errors can be adjusted to within ±17.5 μm by the distribution of the adjustment pixels PX2. Consequently, the present dot formation positioning affords improved positioning accuracy of dots, as compared with cases in which ejecting timing is only adjusted in recording head #H-equivalent units. Also, in cases in which only adjustment of the distribution of adjustment pixels PX2 is performed, errors of ±17.5 μm can also arise between positions of dots by the first reference nozzle 25*a* and the first adjustment candidate nozzle 25*b*. Consequently, the present dot formation positioning affords improved positioning accuracy of dots, as compared with cases in which only adjustment of the distribution of adjustment pixels PX2 is performed.

From the above, positioning accuracy in a direction of relative movement DR1 can be improved for dots DT1 that are formed by a fluid ejection device in which a plurality of recording heads 23 included in the direction of relative movement DR1 of a head section HE1 have a plurality of nozzles 25 in the direction of relative movement DR1.

Figures 2A, 2B, 2C:
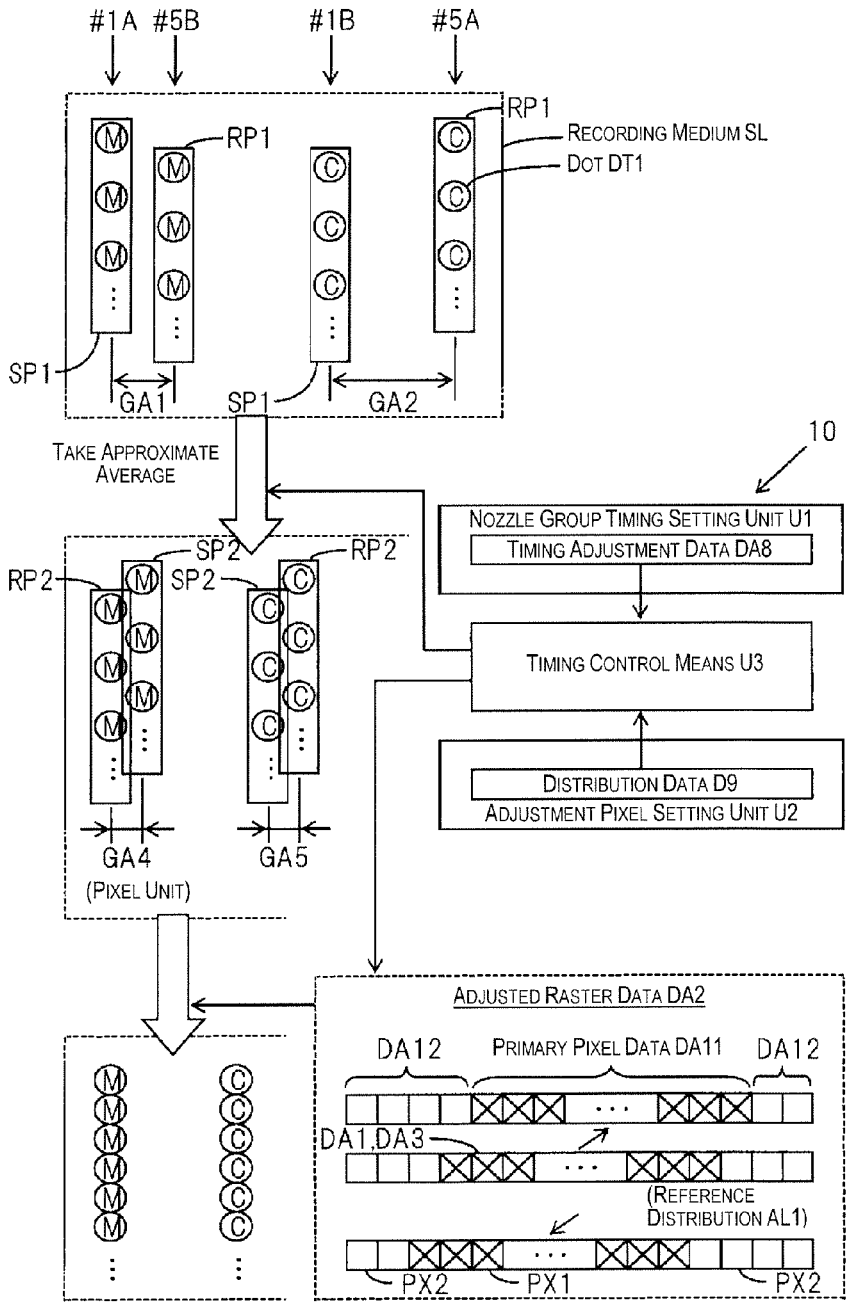
FIGS. 2 A to C are views schematically exemplifying another concept of dot formation positioning.

FIGS. 2 A to C schematically exemplify another concept of dot formation positioning. One feature of the present dot formation positioning is that, even if position displacement of dots DT1 is not compensated for in nozzle group (23)-equivalent units, position displacement of dots DT1 is compensated for through position adjustment corresponding to the direction of relative movement DR1 of the primary pixel data DA11 in the raster data DA1. In the example of FIG. 2 A, nozzles of the nozzle rows #1A and #1B are designated as the first reference nozzles 25*a*, and nozzles of the nozzle rows #5A and #5B are designated as the first adjustment candidate nozzles 25*b*. The reference numerals SP1, RP1 respectively exemplify the aforedescribed first reference pattern (reference position) and the aforedescribed first adjustment pattern. In the direction of relative movement DR1, a position gap between dots formed by nozzle rows #1A and #5B is designated as GA1, and a position gap between dots formed by nozzle rows #1B and #5A is designated as GA2.

In cases in which GA1 and GA2 are different, even if a position gap equivalent to the average thereof, i.e., (GA1+GA2)/2, is compensated for, logically, a position gap of (GA2−GA1)/2 will arise. Thus, the adjustment pixel PX2 distribution can be varied to compensate for position displacement GA4, GA5 in the direction of relative movement DR1 arising between dots formed by the first reference nozzles 25*a* of #1A and #1B and the first adjustment candidate nozzles 25*b* of #5A and #5B. In actual practice, as long as a position gap GA1 between dots formed by #1A and #5B is compensated to produce the pixel-unit order position gap GA4 in order to improve dot positioning accuracy, as exemplified by FIG. 2 C, having brought the positions of dots formed by the nozzle rows #1A and #5B into extremely accurate alignment through adjustment of the adjustment pixel PX2 distribution, the positions of dots formed by the nozzle rows #1B and #5A can then be brought into extremely accurate alignment. As shall be apparent, the position gap GA1 between dots formed by #1A and #5B can be compensated to produce the pixel-unit order position gap GA5 as well.

(2) First Embodiment

Figure 3:
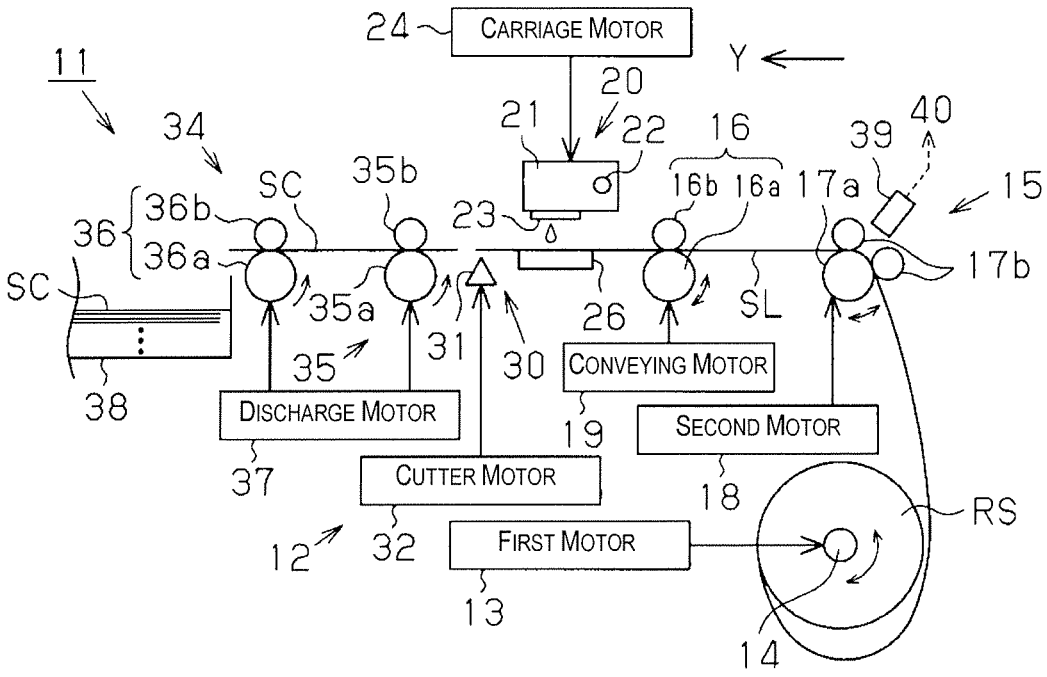
FIG. 3 is a view schematically exemplifying a printer 11 in a first embodiment.

Next, an embodiment of the present technique embodied in an inkjet printer is described with reference to FIGS. 3 to 14. The printer (fluid ejection device) 11 of the present embodiment shown in FIG. 3 is a serial type inkjet recording apparatus. The printer 11 is provided with a conveying device 12 for incrementally unreeling and conveying a printer paper recording medium SL from a roll RS on which a sheet of indefinite length of the recording medium SL has been wound.

Through rotational driving of a shaft member 14 in a predetermined direction by a first motor 13, the recording medium SL of indefinite length is advanced along a conveyance path from the roll RS. The conveying device 12 is provided with an advancer unit 15 for incrementally advancing the recording medium SL sheet from the roll RS, and a conveying roller pair 16 disposed to the downstream side in the conveyance direction from this advancer unit 15. The advancer unit 15 advances the recording medium SL towards the downstream side in the conveyance direction through rotation by an advancer roller 17*a* driven by a second motor 18, and through follower rotation by a follower roller 17*b*.

The conveying roller pair 16 conveys the recording medium SL towards the downstream side in the conveyance direction through rotation by a conveying roller 16*a* driven by a conveying motor 19, and through follower rotation by a follower roller 16*b*.

At a position midway along the recording medium SL of indefinite length in the conveyance direction Y (also referred to as "sub-scanning direction"), a recording unit 20 is furnished for carrying out recording of the recording medium SL. The conveyance direction Y is a sub-scanning direction orthogonal to the main scanning direction X, and the direction DR2 intersects the direction of relative movement DR1. The recording unit 20 is furnished with a carriage 21 capable of reciprocating movement in the main scanning direction X while being guided by a guide rail 22. The carriage 21 has in a portion thereof opposite the recording medium SL a plurality of recording heads (nozzle groups) 23, as an example of a plurality of recording units. These recording heads 23 are supplied with ink (fluid FL1) from ink cartridges, not shown, which are detachably installed in the printer 11. Through forward rotational driving by a carriage motor 24, the carriage 21 undergoes reciprocating movement in the main scanning direction X, and midway through this movement, drive elements PE1 inside the recording heads 23 are driven to spray ink drops towards the surface of the recording medium SL (the upper surface in FIG. 3) from the nozzles 25. The guide rail 22 and the carriage motor 24 constitute relative movement means U41.

Printing of the surface of the recording medium SL is carried out by repeatedly performing in alternating fashion a printing operation equivalent to a single line, which is performed during a single movement (one pass) in the main scanning direction X by the recording heads 23 together with the carriage 21, and a conveying operation by the conveying device 12 to convey the recording medium SL to a position for recording the next line. In the present embodiment, printed images, for example, photos and the like, are printed onto the recording medium SL. At a position opposite the recording heads 23 with the recording medium SL therebetween there is furnished a support member 26 which extends across the widthwise direction of the recording medium SL (the main scanning direction X) in order to support the recording medium SL.

Also, at a cutting position to the downstream side (the left side in FIG. 3) in the conveyance direction from the recording unit 20, a recorded portion is separated from the recording medium SL of indefinite length through movement of a cutter 31 of a cutting unit 30 in the widthwise direction of the recording medium SL (the main scanning direction X) through the driving power of a cutter motor 32. To the downstream side in the conveyance direction from the cutting unit 30 there is furnished a paper discharge unit 34 for discharging a cut sheet SC which has been separated from the recording medium SL, to a point furthest downstream in the conveyance direction.

The paper discharge unit 34 is provided with a plurality of discharge roller pairs 35, 36 disposed along the conveyance direction Y. When a discharge motor 37 is driven, rollers 35*a*, 35*b*, and rollers 36*a*, 36*b* respectively rotate while nipping the recorded cut sheet SC at two positions along the conveyance direction, and discharge the cut sheet SC towards the downstream side in the conveyance direction, where the sheets are collected in stacked form in a discharge tray 38. A detection sensor 39 for detecting the leading edge of the recording medium SL is furnished at a position to the upstream side in the conveyance direction Y from the conveying roller pair 16. A detection signal from this detection sensor 39 is output to a controller 40 which controls the printer 11, and is employed for controlling the conveyance position of the recording medium SL, and the like.

As shown in FIG. 1 A, recording heads 23 are respectively assembled onto the bottom surface of the carriage 21 at a plurality of different positions in the main scanning direction X (direction of relative movement DR1). Two nozzle rows #HA, #HB belonging to the same recording head are mutually shifted by one-half pitch (k/2) in the sub-scanning direction (DR2) to dispose the nozzles 25 in a so-called staggered pattern. Due to the relatively high resolution of the printer 11, the spacing between dots DT1 formed by ink drops sprayed from the nozzles 25 is extremely small. Therefore, it is necessary for the plurality of recording heads 23 to be assembled with good accuracy in the main scanning direction X, but due to variability in attachment, it is difficult to assemble them in a way such that the necessary printing accuracy can be ensured.

FIG. 4 shows a simplified internal configuration of the printer 11, omitting the conveying device 12 and the drive control system. The electrical configuration of the printer 11 is described below.

The printer 11 is provided with an internal controller 40. This controller 40 receives print data from a printer driver PS of a host device HC via an I/F (interface) 41.

The controller 40 has a CPU (Central Processing Unit), an ASIC, a ROM (Read Only Memory), a nonvolatile memory, and RAM (Random Access Memory). Various control programs, various data, and the like are stored in the ROM. Various programs, including a firmware program, various data necessary for the printing process, and the like are stored in the nonvolatile memory. The RAM is employed for temporary storage of results of CPU operations and the like, as well as to hold print data received from the host device HC, print data currently being processed, and processed data.

In addition to the I/F 41, the controller 40 is provided with a reception buffer 42, a command analysis unit 43, an image processing unit 44, a control unit 45, an image buffer 46, a nonvolatile memory 47, a print timing signal generating circuit 48, a head driving unit 49, a carriage driving unit 50, a conveyance driving unit 51, etc. The printer 11 is also furnished with an operation unit 53 for a user to input operations, and input values resulting from operations of the operation unit 53 are input to the control unit 45 via the I/F 41. The command analysis unit 43, the image processing unit 44, and the control unit 45 are realized through at least an ASIC (hardware) and/or a CPU (software) for executing a control program stored in ROM. As shall be apparent, apart from being built through cooperation of software and hardware, the units 43 to 45 could be constituted by software exclusively, or constituted by hardware exclusively. The reception buffer 42 and the image buffer 46 are constituted by RAM.

The carriage 21 is fixed to a portion of a timing belt 57 which loops around a drive pulley 55 linked to the drive shaft of the carriage motor 24, and a driven pulley 56. Through forward rotational driving of the carriage motor 24, the carriage 21 undergoes reciprocating movement in the main scanning direction X via the forward/reverse rotating timing belt 57. At a position to the back surface side of the path of movement of the carriage 21 there is furnished a linear encoder 58 for detecting the position of movement of the carriage 21 (carriage position).

The linear encoder 58 has a tape-shaped code disk 58*a* in which a plurality of slits are formed at a given pitch (for example, $1/180$ inch$=1/180\times2.54$ cm), and a sensor 58*b* having a light-emitting element and a photoreceptor furnished to the carriage 21. When the carriage 21 moves, light emitted from the light-emitting element and passing through a code slit is received by the photoreceptor, whereupon the sensor 58*b* outputs a detection pulse. The controller 40 incorporates, for example, a CR position counter (not shown) for counting the pulse edges of the detection pulses (two pulses phase-shifted by 90 degrees between Phase A and Phase B) input from the linear encoder 58. The count value in the CR position counter is incremented when the carriage is moving away from the home position side, and decremented when moving towards the home position side, and the position of the carriage 21 having a home position HP as its origin can thus be ascertained.

The printer driver PD performs known color conversion processing, resolution conversion processing, halftone processing, rasterization processing, and the like on image data of a color system for monitor display (for example, the RGB color system) to generate print data. This print data includes control commands and printed image data.

The aforedescribed control commands which are described in a header have been created on the basis of printing parameter data and the aforedescribed printed image data, and therefore is composed of various commands, such as paper supply operation, paper feed operation, paper discharge operation, and other conveying system commands, as well as carriage operation, recording head operation (recording operation), and other printing system commands, and the like. In the case of the present example, when one of a plurality of prepared printing modes is selected as one of the printing parameters, depending on the selected printing mode, either "bidirectional printing" or "unidirectional printing" is selected.

The reception buffer 42 is a storage area (holding area) for temporarily holding print data received via the I/F 41. The command analysis unit 43 reads out the header of the print data from the reception buffer 42, acquires control commands, etc., therein, and analyzes the control commands which are described in the printer description language. The results of command analysis are sent to a head control unit 63, a carriage control unit 64, and a conveyance control unit 65 of the control unit 45.

The image processing unit 44 reads out one-line (main scan line) increments from the reception buffer 42 the aforedescribed printed image data which includes the raster data DA1, performs invention image processing, and holds the image-processed head image data in the image buffer 46. The present image processing unit 44 inputs from the control unit 45 information relating to an adjustment pixel distribution represented by the distribution data DA9, and generates adjusted raster data DA2 as data representing the adjustment pixel data DA12 of the raster data DA1 as adjustment pixels PX2 of the aforedescribed distribution (DA9).

The control unit 45 is provided with an adjustment unit 61, an instruction unit 62, the head control unit 63, the carriage control unit 64, and the conveyance control unit 65. The adjustment unit 61 acquires adjustment values for ejection timing and adjustment pixel distribution, on the basis of information input from the operation unit 53. The adjustment unit 61 has a computation unit 67 for performing various computations necessary to determine ejection timing and adjustment pixel distribution. The instruction unit 62 individually adjusts the ejection timing of each recording head 23. In so doing, the control unit 45 performs processing to incrementally vary the combination of ejection timing of the recording heads 23 and print an adjustment chart CT1 exemplified in FIG. 8 A. The head control unit 63 controls the head driving unit 49 in accordance with results of command analysis from the command analysis unit 43. The carriage control unit 64 recognizes the direction of movement of the carriage 21 on the basis of phase difference between encoder pulse signals ES of two phases, i.e., Phase A and Phase B, input from the linear encoder 58. Each time that an edge of an encoder pulse signal ES is detected, the carriage control unit 64, during outbound movement, increments a carriage counter, or during return movement decrements it, to thereby detect the position of movement of the carriage 21 from its origin position (for example, the home position). This position of the carriage 21 in the main scanning direction X is employed for speed control of the carriage motor 24. The conveyance control unit 65 controls the conveyance driving unit 51 for driving conveyance of the recording medium SL, in accordance with results of command analysis from the command analysis unit 43.

In the nonvolatile memory 47 are stored chart printing data CP, timing adjustment data DA8, distribution data DA9, etc. The nonvolatile memory can take the form of a nonvolatile memory known as flash memory, a magnetic disk known as a hard disk, or the like. The chart printing data CP is print data for forming adjustment charts CT1, CT2 exemplified in FIGS. 8 A and B. The raster data of the print data for forming the adjustment chart CT1 for ejection timing adjustment is designated as reference raster data DA3 in which the adjustment pixels PX2 are positioned according to the reference distribution AL1, as exemplified in the middle row in FIG. 5 C. The raster data of the printer data for forming the adjustment chart CT2 for adjustment pixel distribution is designated as reference raster data DA4 in which primary pixels PX1 are shifted in one-pixel increments towards the direction of relative movement DR1 as exemplified in the upper to lower rows in FIG. 5 C.

The timing adjustment data DA8 is data that represents ejection timing intended to compensate for position displacement of dots DT1 formed by the recording heads 23, with respect to reference positions (the first reference pattern SP1 of FIG. 8) in the direction of relative movement DR1. The timing adjustment data DA8 exemplified in FIG. 6 A has adjustment values for each recording head #H during outbound movement and return movement of the carriage 21. Because head #1 has been designated as the reference head, the present timing adjustment data DA8 designates the adjustment value of the head #1 as 0. The adjustment value of the reference head can of course be a value other than 0. The distribution data D9 is data representing an adjustment pixel distribution setting intended to compensate for position displacement of dots DT1 in the direction of relative movement DR1 between dots DT1 formed by the nozzle rows #HA, #HB which constitute the recording heads #H, at the ejection timing represented by the timing adjustment data DA8. The distribution data DA9 exemplified in FIG. 6 B has adjustment values for the nozzle rows #1B, #2B, #3B, #4A, and #5A during outbound movement and return movement of the carriage 21. Because nozzle row #1B has been designated as the reference nozzle row, the present distribution data DA9 designates the adjustment value of the nozzle row #1B as 0. As shall be apparent, the adjustment value of the reference nozzle row can be a value other than 0. All of the nozzle rows #HA, #HB can be respectively furnished with adjustment values as well, as exemplified in FIG. 6 C.

Next, dot formation positioning by the aforedescribed adjustment pixel distribution is described with reference to FIGS. 5 A to C. The structure of the raster data DA1 shown in FIG. 5 A is one in which adjustment pixel data DA12 is disposed to either side of the primary pixel data DA11 in the main scanning direction (the direction of relative movement DR1), with these sets of data being lined up in the sub-scanning direction (DR2). The primary pixels PX1 constituting the primary pixel data DA11 store data that represents states of formation of dots DT1 on the recording medium SL. The adjustment pixels PX2 constituting the adjustment pixel data DA12 can be, for example, pixels that do not form dots, and which are employed for adjusting the positions of the primary pixels PX1 in the main scanning direction. The adjustment pixels can also be pixels for forming colorless dots, known as picture quality-adjusting ink, or the like, because it suffices for the adjustment pixels PX2 to be pixels for the purpose of position adjustment corresponding to the direction of relative movement DR1 of the primary pixel data DA11 in the raster data DA1.

Figure 5A:
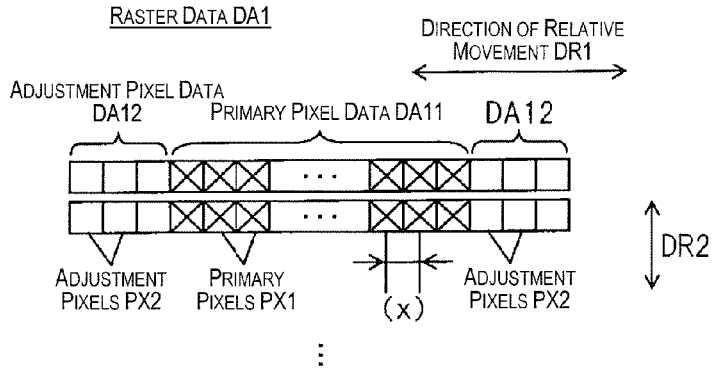
FIG. 5 A is a view schematically exemplifying a structure of raster data DA1, B is a view schematically exemplifying pixels formed on a recording medium SL, and C is a view schematically exemplifying setting an adjustment pixel PX2 distribution to compensate for position displacement in formation of dots DT1.
Figure 5B:
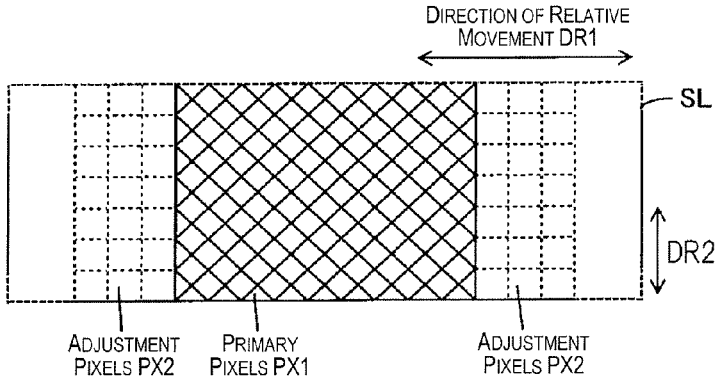
Figure 5C:
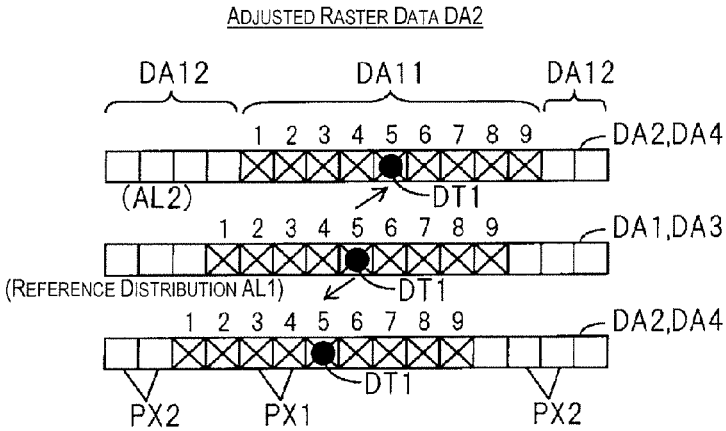

FIG. 5 B schematically exemplifies pixels PX1, PX2 which are formed on the recording medium SL by the fluid ejection device (11). The primary pixels PX1 are arrayed in the center portion in the main scanning direction (DR1) of the recording medium SL, with the adjustment pixels PX2 arrayed at either edge thereof. Dots for reproducing an image received from the printer driver PD are formed on the primary pixels PX1. Therefore, the primary pixels PX1 are arrayed two-dimensionally in the main scanning direction (DR1) and the sub-scanning direction (DR2), and constitute two-dimensional image data. The adjustment pixels PX2 are used to adjust the positions for image formation in the main scanning direction, in response to displacement of dot formation positions.

FIG. 5 C schematically exemplifies compensating for displacement of formation positions of dots DT1 through adjustment of the adjustment pixel distribution. There can be considered a case in which, for example, dots are displaced leftward from the normal pixels. There can be considered a case in which, where ink (fluid FL1) was ejected at the timing for formation of a dot on the fifth pixel, a dot DT1 is instead displacedly formed on the fourth pixel. In this case, the raster data DA1 is adjusted so that ink is ejected at the timing for formation of a dot on the sixth pixel. Thus, a dot will be formed on the fifth pixel. That is, through adjustment of raster data in consideration of the amount of displacement, a dot can be formed on the normal pixel. Setting of the adjustment pixel distribution is performed on this basic principle, in order to compensate for displacement of dot formation position.

The pixels assigned reference numerals 1 to 9 in FIG. 5 C are primary pixels PX1. The middle row in FIG. 5 C shows raster data DA1 furnished respectively at either end thereof with a set of three adjustment pixels PX2. The black circle on the fifth primary pixel PX1 in the raster data DA1 signifies formation of a dot DT1 on the fifth primary pixel PX1. For a nozzle 25 having the characteristic of forming dots DT1 at formation positions displaced leftward by the equivalent of one pixel, the raster data DA1 would be modified such that the dot DT1 that normally would be formed on the fifth primary pixel PX1 is instead formed on the next pixel to the right. The adjusted raster data DA2 in this case is shown in the top row in FIG. 5 C. The state of the adjusted raster data DA2 is one entirely shifted rightward by the equivalent of one pixel, specifically, a state in which the distribution of the adjustment pixels PX2, which normally are distributed in sets of three pixels to either side, has been modified to four pixels on the left side and two pixels on the right side. On the other hand, for a nozzle 25 having the characteristic of forming dots DT1 at formation positions displaced rightward by the equivalent of one pixel, the raster data DA1 would be modified so that the dot DT1 that normally would be formed on the fifth primary pixel PX1 is instead formed on the next pixel to the left. By executing printing on the basis of the adjusted raster data DA2, dots DT1 are formed at positions where they should normally be formed.

A distribution of the adjustment pixels PX2 is set up in the form of the distribution data DA9 shown in FIGS. 6 B and C. The distribution data DA9 of FIG. 6 B is premised on mutual adjustment of ejection timing of the nozzle rows #1A, #2A, #3A, #4B, and #5B through ejection timing adjustment, and has adjustment values for the nozzle rows #1B, #2B, #3B, #4A, and #5A. The distribution data DA9 of FIG. 6 C is premised on the heads #H being the unit for performing ejection timing, with the data including adjustment values for all of the nozzle rows #HA and #HB. As shall be apparent, in cases in which ink is ejected only during main scanning in one direction of the head section HE1, as in unidirectional printing, adjustment values during return movement are unnecessary.

Figure 7:
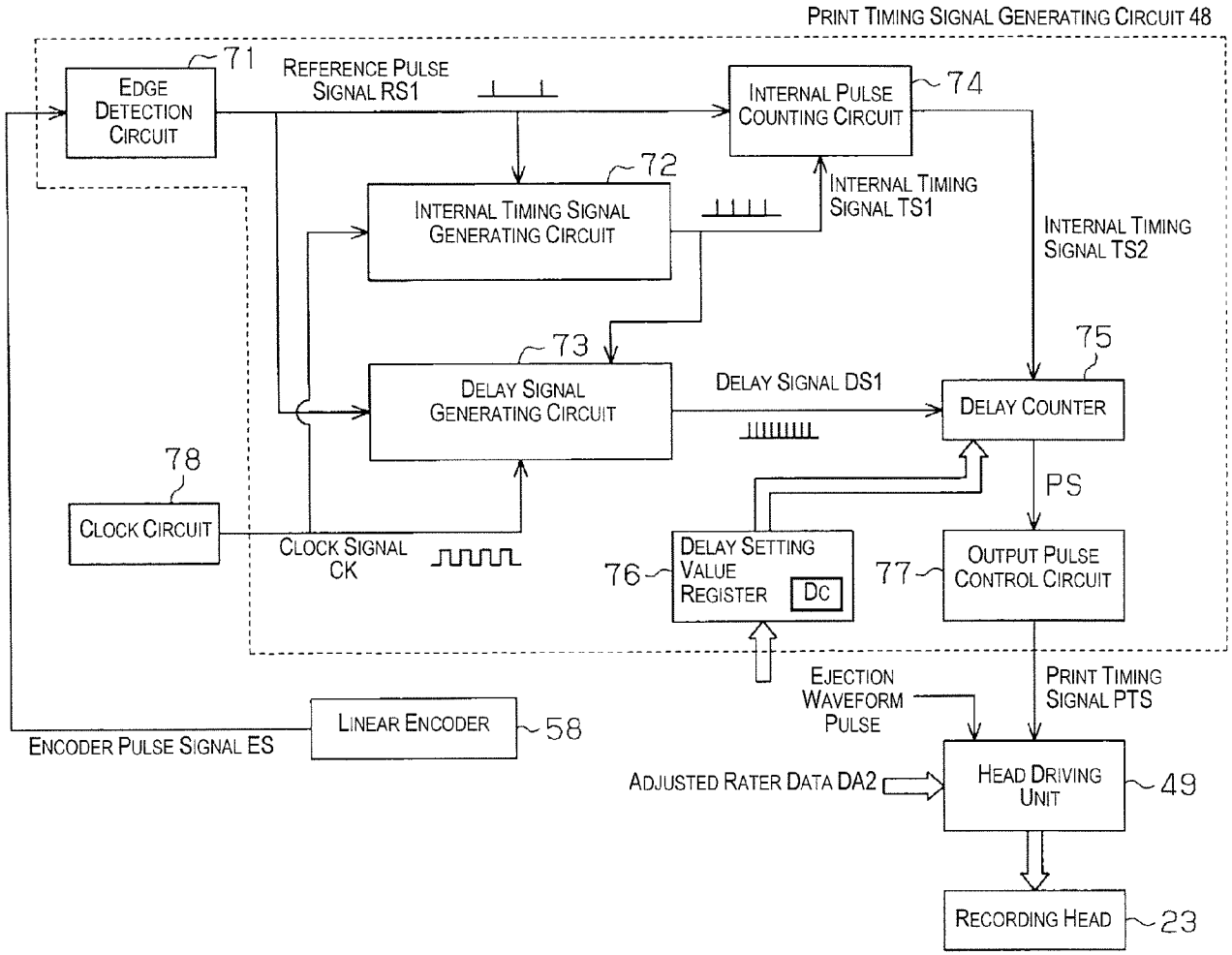
FIG. 7 is a block diagram exemplifying the electrical configuration of a print timing signal generating circuit 48.

Next, the configuration of the print timing signal generating circuit 48 shown in FIG. 7 is described. The print timing signal generating circuit 48 is furnished, for example, within an ASIC, and is adapted to generate a print timing signal PTS on the basis of an encoder pulse signal ES input from the linear encoder 58.

The print timing signal generating circuit 48 is provided with an edge detection circuit 71, an internal timing signal generating circuit 72, a delay signal generating circuit 73, an internal pulse counting circuit 74, a delay counter 75, a delay setting value register 76, an output pulse control circuit 77, and the like.

The edge detection circuit 71 generates a pulse each time a rising edge is detected in the encoder pulse signal ES input from the sensor 58*b* of the linear encoder 58, and generates a reference pulse signal RS1. This reference pulse signal RS1 is input to the internal timing signal generating circuit 72, the delay signal generating circuit 73, and the internal pulse counting circuit 74.

The signal generation processing performed by the print timing signal generating circuit 48 includes a cycle division process (multiplication process) for dividing (multiplying) the cycle of the reference pulse signal RS1 to generate pulses of a plurality of cycles resulting from division of a single cycle thereof; and a delay process for delaying the pulse signal obtained from the cycle division process, by a delay interval which is determined in response to the speed of movement, the direction of movement (difference between outbound movement and return movement), and the like of the carriage 21, and generating a print timing signal.

The internal timing signal generating circuit 72 inputs the reference pulse signal RS1 from the edge detection circuit 71, as well as inputting a clock signal CK from a clock circuit 78. The internal timing signal generating circuit 72 performs cycle division processing to divide the cycle of the reference pulse signal RS1 into 16 cycles, generating an internal timing signal TS1 pulsed according to a cycle (1/16). The internal timing signal generating circuit 72 then outputs the generated internal timing signal TS1 to the delay signal generating circuit 73 and the internal pulse counting circuit 74

The delay signal generating circuit 73 inputs the reference pulse signal RS1 from the edge detection circuit 71, inputs the clock signal CK from the clock circuit 78, and further inputs the internal timing signal TS1 from the internal timing signal generating circuit 72. The delay signal generating circuit 73 performs cycle division processing to divide the cycle of the reference pulse signal RS1 and generate a delay signal DS1 pulsed according to a cycle that is 1/128 of the cycle of the internal timing signal TS1. The delay signal generating circuit 73 then outputs the generated delay signal DS1 to the delay counter 75.

The internal pulse counting circuit 74 inputs the reference pulse signal RS1 from the edge detection circuit 71, as well as inputting the internal timing signal TS1 from the internal timing signal generating circuit 72. This internal pulse counting circuit 74 counts up the pulses of the internal timing signal TS1, and outputs a new internal timing signal TS2 for generating pulses each time that the count result goes to "15," as well as in cases in which a pulse of the reference pulse signal RS1 has been input. Then, in a case of being reset through input of a reference pulse signal RS1, the internal pulse counting circuit 74 outputs the first internal timing signal TS2 of the next cycle. In this way, the internal pulse counting circuit 74 outputs an internal timing signal TS2 that includes 16 pulses in the course of a single cycle of the reference pulse signal RS1. This internal timing signal TS2 is employed as a reference signal for determining the ejection timing (drive timing) for ejecting ink, and is output to the delay counter 75.

The delay counter 75 inputs the internal timing signal (reference signal) TS2 from the internal pulse counting circuit 74, as well as inputting the delay signal DS1 from the delay signal generating circuit 73. The delay counter 75 has a function of delaying output of the internal timing signal TS2 by a delay time, on the basis of a delay setting value Dc stored in the delay setting value register 76. The minimum unit of the delay setting value Dc is smaller than the pitch x in the direction of relative movement DR1 of the pixels PX1, PX2 which constitute the adjusted raster data (see FIG. 12). Consequently, the delay counter 75 delays the internal timing signal TS2 so as to adjust the formation positions for the dots DT1 in the direction of relative movement DR1, in units that are smaller than the pitch x of the pixels. The delay setting value Dc is based on the timing adjustment data DA8 shown in FIG. 6 A. In cases in which ink is ejected only during main scanning of the head section HE1 in one direction, as in unidirectional printing, adjustment values during return movement are unnecessary. Delay setting values Dc are furnished for every one of the recording heads 23.

The output pulse control circuit 77 outputs a print timing signal PTS pulsed at a rate of once per one pulse of a preliminary timing signal PS. This print timing signal PTS is output to the head driving unit 49, which is electrically connected to the output pulse control circuit 77.

The present head driving unit 49 generates pulses of three different ejection waveforms through a drive signal generating circuit inside it. Here, the ejection waveform pulse with the greatest voltage difference is a voltage pulse for ejecting an ink drop for a large dot; the ejection waveform pulse with the smallest voltage difference is a voltage pulse for ejecting an ink drop for a small dot; and the ejection waveform pulse with an intermediate voltage difference is a voltage pulse for ejecting an ink drop for a medium dot. As four tone values representing large, medium, small, and no dot, for example, tone values of "0," "1," "2," and "3" can be respectively associated with "no dot," "small dot," "medium dot," and "large dot," respectively. It is of course possible for the head driving unit to use a number of ejection waveform pulses other than three, specifically, one, two, or four or more. The head driving unit 49 selects at least one predetermined ejection waveform pulse from among the three on the basis of input tone value data, and applies the selected ejection waveform pulse to the voltage elements inside the recording heads 23, at a timing based on the print timing signal PTS. As a result, the ejection waveform pulse (drive voltage) is applied to those voltage elements that among the voltage elements are those corresponding to nozzles that have values other than non-ejection values in the tone value data so as to print pixels, whereupon ink drops are sprayed from the nozzles corresponding to those voltage elements. For each of the recording heads 23, the print timing signal generating circuit 48 of the present embodiment is furnished with a circuit portion configured as shown in FIG. 7. Consequently, ejecting timing can be set for each of the recording heads 23.

Figure 8A:
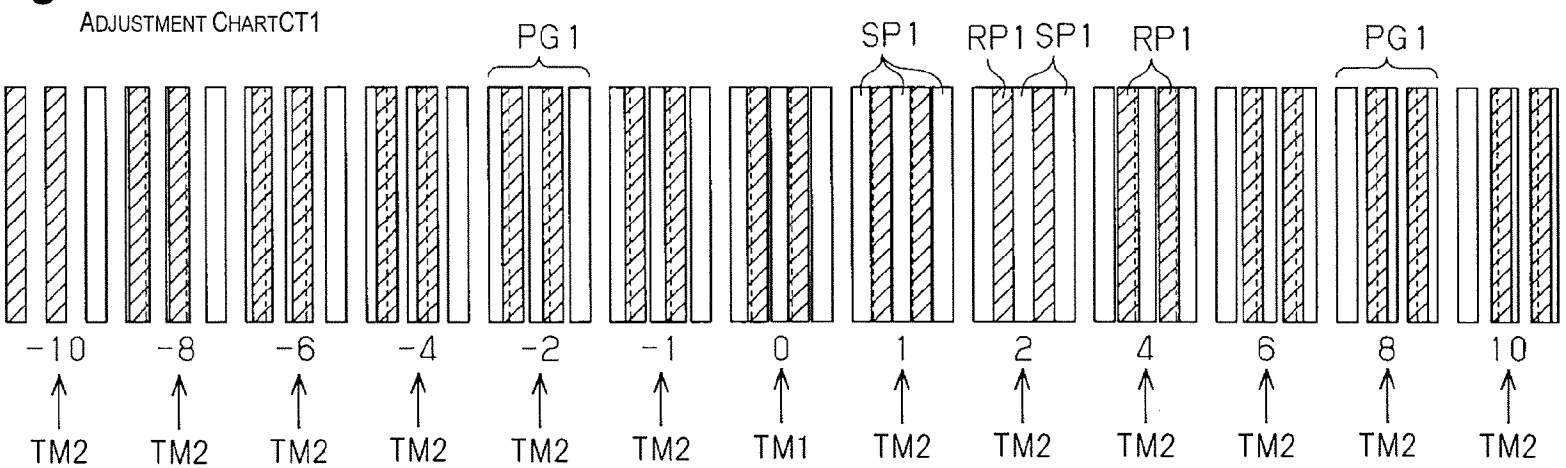
FIGS. 8 A and B are views schematically exemplifying portions of adjustment charts.
Figure 8B:
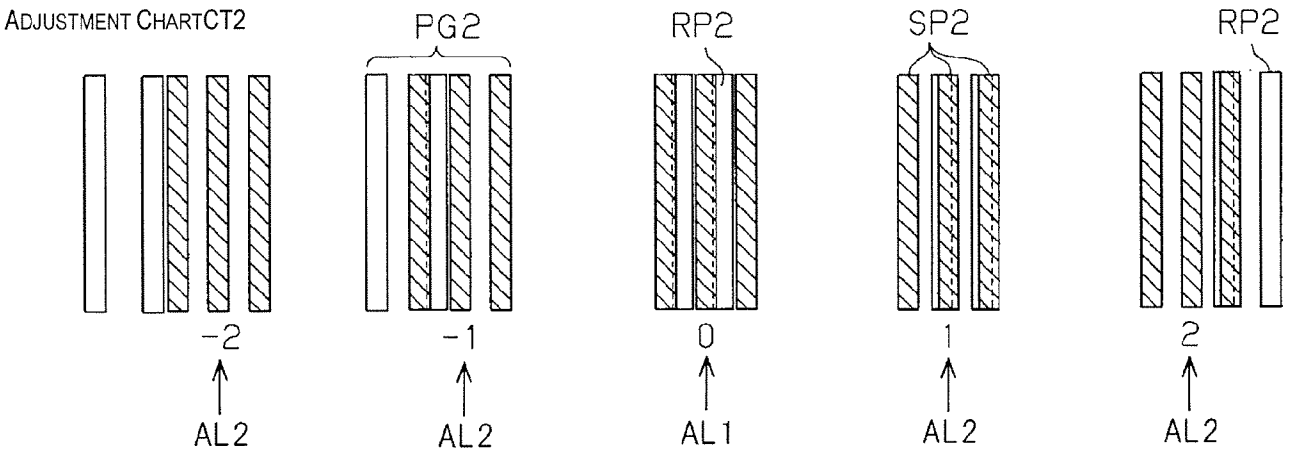

FIG. 8 A shows an adjustment chart CT1 for adjusting ejection timing of each recording head 23 in the direction of relative movement DR1. The adjustment chart CT1 is constituted by recording onto the recording medium SL a plurality of combinations PG1 of first reference patterns SP1 and first adjustment patterns RP1. As one example, there can be considered a case in which ejection timing among the nozzle rows #1A, #2A, #3A, #4B, and #5B representative of each of the heads #H are to be brought into alignment with reference to the nozzle row #1A. As shall be apparent, there are various possible combinations of nozzle rows representative of each of the heads #H. In the case of the aforedescribed example, the nozzles of #1A are designated as the first reference nozzles 25*a* and the nozzles of #2A, #3A, #4B, and #5B are designated as the first adjustment candidate nozzles 25*b*, and it is possible to form four different charts, i.e., an adjustment chart CT1 by nozzle rows #1A and #2A, an adjustment chart CT1 by nozzle rows #1A and #3A, an adjustment chart CT1 by nozzle rows #1A and #4B, and an adjustment chart CT1 by nozzle rows #1A and #5B. In the respective adjustment charts CT1, when an operation is input to the printer 11 from the operation unit 53 to specify a numerical value (adjustment value) corresponding to one optimal group of patterns from among a plurality of groups of patterns (PG1), a delay value is set to correspond to the input numerical value, and the ejection timing among the heads #H is adjusted. Here, the input numerical value is a numerical value that corresponds to the delay pulse count from the reference pulse.

In the example of FIG. 8 A, adjustment values are varied among 13 different values of "−10, −8, −6, −4, −2, −1 0, 1, 2, 4, 6, 8, 10" centered on an adjustment value of "0." The first adjustment pattern RP1 having an adjustment value of "0" is formed by ejection of ink from the first adjustment candidate nozzles 25*b* at a reference ejection timing TM1. The first adjustment patterns RP1 having adjustment values other than "0" are formed by ejection of ink from the first adjustment candidate nozzles 25*b* at different adjustment ejection timings TM2 with reference to the reference ejection timing TM1. Where adjustment charts CT1 are printed as in the example of FIG. 8 A, the pattern produced when the numerical value is "2" is a pattern that affords printing of the dots DT1 at optimal positions.

In cases in which it is considered important to bring about position alignment in the main scanning direction (DR1) for nozzle rows of the same color in different recording heads 23, adjustment charts CT1 can be respectively formed for the nozzle rows #1A and #5B, for the nozzle rows #2A and #4B, for the nozzle rows #1A and #2A, and for the nozzle rows #1A and #3A. Here, the amount of adjustment of ejection timing of nozzle row #5B with respect to the nozzle row #1A is designated as h15, the amount of adjustment of ejection timing of nozzle row #4B with respect to nozzle row #2A as h24, the amount of adjustment of ejection timing of nozzle row #2A with respect to nozzle row #1A as h12, and the amount of adjustment of ejection timing of nozzle row #3A with respect to nozzle row #1A as h13. The amount of adjustment h14 of ejection timing of nozzle row #4B with respect to nozzle row #1A is equal to h12+h24. Consequently, for example, adjustment amounts of the nozzle rows #2A, #3A, #4B, and #5B with reference to the nozzle row #1A can be respectively designated as h12, h13, h14, and h15.

FIG. 8 B shows an adjustment chart CT2 for adjusting the adjustment pixel distribution. The adjustment chart CT2 is composed by printing on the recording medium SL a plurality of combinations PG2 of second reference patterns SP2 and second adjustment patterns RP2. As one example, there can be considered a case in which, on the premise of mutual adjustment of ejection timing of the nozzle rows #1A, #2A, #3A, #4B, and #5B, the adjustment pixel distribution among the nozzle rows #1B, #2B, #3B, #4A, and #5A is to be adjusted with reference to the nozzle row #1B. As shall be apparent, various possible combinations of nozzle rows can be subjected to adjustment of the adjustment pixel distribution, depending on the nozzle rows representative of each of the heads #H. Also, the adjustment pixel distribution can be adjusted for all nozzle rows, as shown in FIG. 6 C. In the case of the aforedescribed example, for example, designating the nozzles of #1B as the second reference nozzles 25*c* and the nozzles of #2B, #3B, #4A, and #5A as the second adjustment candidate nozzles 25*d*, there can be formed four different charts, i.e., an adjustment chart CT2 by nozzle rows #1B and

#2B, an adjustment chart CT2 by nozzle rows #1B and #3B, an adjustment chart CT2 by nozzle rows #1B and #4A, and an adjustment chart CT2 by nozzle rows #1B and #5A. In the respective adjustment charts CT2, when an operation is input to the printer 11 from the operation unit 53 to specify a numerical value (adjustment value) corresponding to one optimal group of patterns from among a plurality of groups of patterns (PG2), an adjustment pixel distribution is set for the image processing unit 44, and position displacement among the nozzle rows #1B, #2B, #3B, #4A, and #5A is compensated for in pixel-equivalent units. Here, the input numerical value is a numerical value that corresponds to the adjustment pixel distribution.

In the example of FIG. 8 B, adjustment values are varied among five different values of "−2, −1 0, 1, 2" centered on an adjustment value of "0." The second adjustment pattern RP2 having an adjustment value of "0" is formed by ejection of ink from the second adjustment candidate nozzles 25*d* in accordance with adjustment raster data DA4 having an adjustment distribution AL2 of the adjustment pixels PX2 as a reference distribution AL1. The second adjustment patterns RP2 having adjustment values other than "0" are formed by ejection of ink from the second adjustment candidate nozzles 25*d* in accordance with adjustment raster data DA4 in which the adjustment pixels PX2 are distributed in the main scanning direction with reference to the reference distribution AL1 of the adjustment pixels. The adjustment distribution AL2 is a distribution having reference to the reference distribution AL1. Where adjustment charts CT2 are printed as in the example of FIG. 8 B, the pattern produced when the numerical value is "0" is a pattern that affords printing of the dots DT1 at optimal positions.

In cases in which it is considered important to bring about position alignment in the main scanning direction (DR1) for nozzle rows of the same color in different recording heads 23, adjustment charts CT2 can be respectively formed for the nozzle rows #1B and #5A, for the nozzle rows #2B and #4A, for the nozzle rows #1B and #2B and for the nozzle rows #1B and #3B. As shall be apparent, with the adjustment amount of the adjustment pixel distribution of nozzle row #5A with respect to the nozzle row #1B designated as g15, the amount of adjustment of the adjustment pixel distribution of nozzle row #4A with respect to nozzle row #2B as g24, the amount of adjustment of the adjustment pixel distribution of nozzle row #2B with respect to nozzle row #1B as g12, and the amount of adjustment of the adjustment pixel distribution of nozzle row #3B with respect to nozzle row #1B as g13, the amount of adjustment g14 of the adjustment pixel distribution of nozzle row #4A with respect to nozzle row #1B is equal to g12+g24. Consequently, for example, adjustment amounts of the nozzle rows #2B, #3B, #4A, and #5A with reference to the nozzle row #1B can be respectively designated as g12, g13, g14, and g15.

The control unit 45 performs printing of the adjustment charts CT1, CT2 upon receiving an instruction to execute printing of an adjustment chart CT2 according to operation of the operation unit 53 by a user, or upon receiving a print instruction signal from the printer driver PD indicating that and instruction to execute printing of an adjustment chart was received through operation of an operation unit of the host device HC. When an instruction to execute printing of an adjustment chart CT1 for adjustment of the ejection timing is received, the control unit 45 sets the adjustment pixel distribution for the image processing unit 44 to the reference distribution AL1. The instruction unit 62 of the control unit 45 then sends data for printing a chart to adjust ejection timing, which data has been saved in the nonvolatile memory 47, to the image processing unit 44; and also instructs the head control unit 63, the carriage control unit 64, and the conveyance control unit 65 to perform an operation to print the adjustment chart CT1 on the basis of the data for chart printing. At this time, the image processing unit 44 performs image processing of the data for chart printing sent to it. The head control data obtained through image processing, and raster data having adjustment pixels PX2 placed according to the reference distribution AL1, are sent to the head driving unit 49 via the image buffer 46.

Upon receiving an instruction to execute printing of an adjustment chart CT2 for adjustment of the adjustment pixel distribution, the control unit 45 sends to the image processing unit 44 data for chart printing composed of adjustment raster data DA4 in which the primary pixels PX1 have been shifted in stepwise fashion in the direction of relative movement DR1 as shown in FIG. 5 C, and also instructs the head control unit 63, the carriage control unit 64, and the conveyance control unit 65 to perform an operation to print the adjustment chart CT2 on the basis of the data for chart printing. At this time, the image processing unit 44 performs image processing of the data for chart printing. The head control data obtained through image processing and the adjustment raster data DA4 are sent to the head driving unit 49 via the image buffer 46.

Figure 9A:
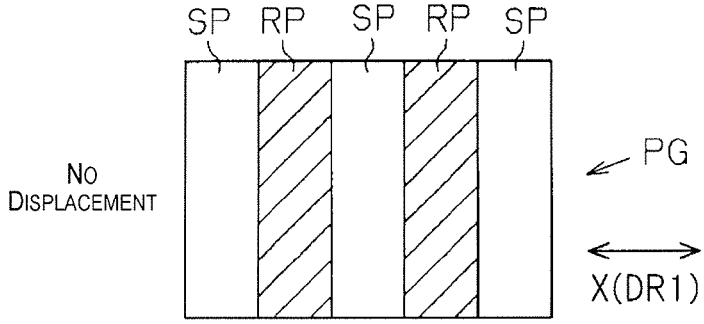
FIGS. 9 A to C are views schematically exemplifying relative positional relationships of reference patterns SP and adjustment patterns RP.
Figure 9B:
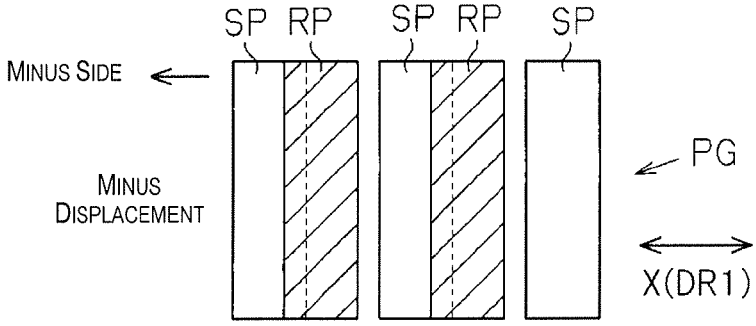
Figure 9C:
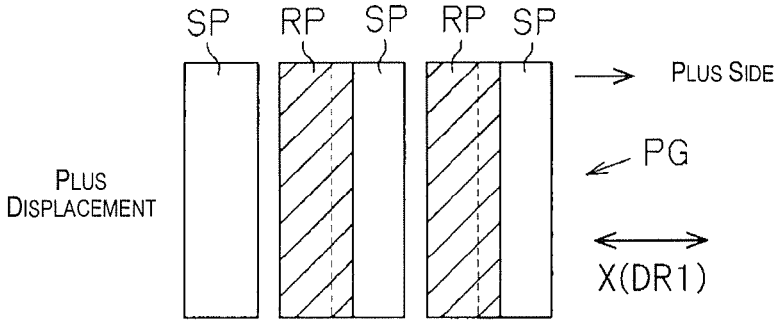
Figure 10A:
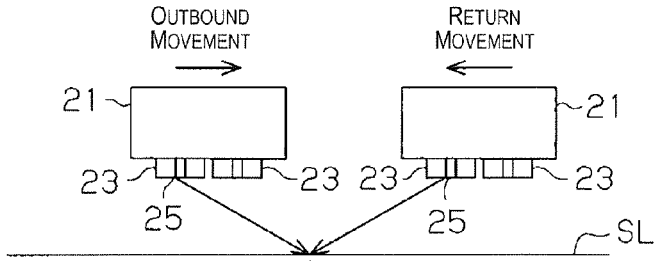
FIGS. 10 A to D are views schematically exemplifying timing of recording (ejection) of patterns.
Figure 10B:
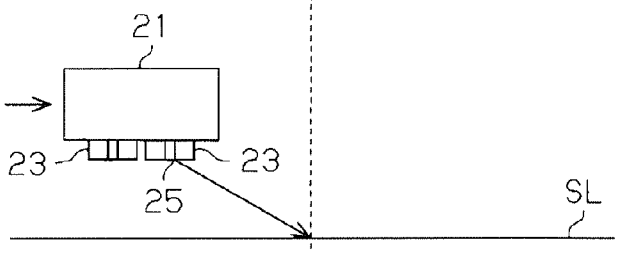
Figure 10C:
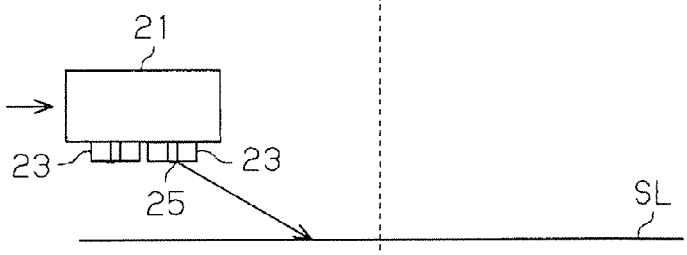
Figure 10D:
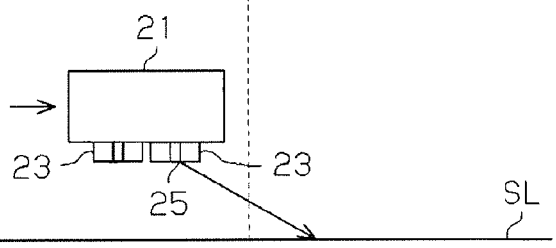

FIGS. 9 A to C schematically exemplify relative positional relationships of reference patterns SP and adjustment patterns RP. Here, in the case of adjusting the ejection timing, the reference patterns SP would correspond to the first reference patterns SP1, and the adjustment patterns RP would correspond to the first adjustment patterns RP1. In the case of adjusting the adjustment pixel distribution, the reference patterns SP correspond to the second reference patterns SP2, and the adjustment patterns RP correspond to the second adjustment patterns RP2. A single group of patterns (PG) is constituted, for example, by three reference patterns SP recorded by nozzle rows of a reference recording head, and two adjustment patterns RP recorded by nozzle rows of a recording head that is a candidate for adjustment. The three reference patterns SP are constituted by rectangular patterns of identical length and identical width, with the spacing of the reference patterns SP in the main scanning direction DR1 being equal to the width of the adjustment patterns RP. The two adjustment patterns RP are respectively constituted by rectangular patterns of identical length and identical width, with the spacing of the adjustment patterns RP in the main scanning direction DR1 being equal to the width of the reference patterns SP.

As shown in FIG. 9 A, in the absence of displacement, the reference patterns SP and the adjustment patterns RP are disposed adjacently. This state is a parameter for optimal printing timing. As shown in FIG. 9 B, in the case where the adjustment patterns RP are displaced towards the minus side, the left side portion (minus side portion) of the adjustment patterns RP partially overlaps the reference patterns SP situated adjacently left therefrom, while a gap occurs between the right side portion (plus side portion) thereof and the reference patterns SP situated adjacently right therefrom. As shown in FIG. 9 C, in the case where the adjustment patterns RP are displaced towards the plus side, a gap occurs between the left side portion (minus side portion) of the adjustment patterns RP and the reference patterns SP situated adjacently left therefrom, while the right side portion (plus side portion) thereof partly overlaps the reference patterns SP situated adjacently right therefrom. Thus, a pattern should be found in which the reference patterns SP and the adjustment patterns RP are disposed in neatly adjacent fashion with no gap or overlap, and a numerical value (adjustment value) corresponding to this pattern input should also be found.

FIGS. 10 A to D schematically exemplify the ejection timing of recording heads when printing an adjustment chart. FIG. 10 A shows the ejection timing when printing a reference pattern SP. In FIG. 10 A, the landing position of an ink drop sprayed at predetermined timing from a reference recording head (e.g., #1) is designated as a reference position in the main scanning direction X. The delay setting value Dc that determines the standard spray timing at this time is designated as Ds (Dc=Ds). FIG. 10 B shows the ejection timing when an appropriate pattern is printed by a recording head that is a candidate for adjustment (e.g., #5). In this case, a pattern combination PG free of displacement as shown in FIG. 9 A is printed, and a delay setting value Dc=Do for determining reference spray timing at this time is designated as the optimal delay setting value for the recording head.

FIG. 10 C shows ejection timing when a pattern displaced towards the minus side is printed by a recording head that is a candidate for adjustment. In this case, a combination of patterns PG displaced towards the minus side as shown in FIG. 9 B are printed, and the delay setting value Dc is set with displacement towards the minus side with respect to Do (Dc=Do−d). d is the amount of displacement. FIG. 10 D shows ejection timing when a pattern displaced towards the plus side is printed by a recording head that is a candidate for adjustment. In this case, a combination of patterns PG displaced towards the plus side as shown in FIG. 9 C are printed, and the delay setting value Dc is set with displacement towards the plus side with respect to Do (Dc=Do+d).

In order to guarantee high print quality during bidirectional printing (Bi-d printing), in which printing is performed both during outbound movement and during return movement of the carriage 21, it is necessary to align the landing positions during outbound movement and the landing positions during return movement. Therefore, patterns are printed while changing the ejection timing, i.e., the delay setting value Dc, of outbound movement, and patterns are printed while changing the ejection timing, i.e., the delay setting value Dc, of return movement. A pattern combination affording an optimal positional relationship in the main scanning direction between the patterns printed during outbound movement and the patterns printed during return movement is then found, and numerical values corresponding to the patterns are input. Setting of adjustment values for Bi-d is performed using a given reference recording head (for example, #1). As shall be apparent, adjustment values for Bi-d could also be set using a recording head other than #1.

FIG. 11 describes a configuration of data for chart printing, employed when printing an ejection timing adjustment chart CT1, and shows each scan (pass) of the carriage 21 separately. Three reference patterns are shown schematically as a single rectangular pattern, and two adjustment patterns are shown schematically as a single rectangular pattern. In the present embodiment, in order to reduce the number of passes needed for chart printing, not only is the ejection timing switched, but the formation positions of the patterns in the data for chart printing are devised in such a way as to reduce the number of passes needed to print the adjustment patterns.

FIG. 12 schematically exemplifies recorded pixels. When the minimum unit of the delay setting value Dc is denoted as Δd, where the pitch of adjacent pixels PX3 in the main scanning direction is denoted as x, x=10·Δd. In this case, where the printing position of an adjustment pattern RP is displaced toward the minus direction by the equivalent of one pixel pitch x, even when the pattern is printed at ejection timing such that the display setting value Dc=Do (displacement of 0), the printing position of the printed result is substantially identical to that when printed at ejection timing such that the display setting value Dc=−10. Consequently, adjustment patterns RP of delay adjustment amounts of "−10," '0', and "10" can be printed in one pass. As shall be apparent, adjustment patterns RP of delay adjustment amounts of "−8" and "2" can be printed in one pass, or adjustment patterns RP of delay adjustment amounts of "−6" and "4" can be printed in one pass.

From the above, for example, in a first pass, the reference head can be employed to print reference patterns SP at a predetermined display setting value Dc=Ds, and then recording heads that are candidates for adjustment can be employed to print adjustment patterns RP of "−10," '0', and "10." In a second pass, adjustment patterns RP of "−8," and "2" can be printed. In a third pass, adjustment patterns RP of "−6," and "4" can be printed. In a fourth pass, adjustment patterns RP of "−4," and "6" can be printed. In fifth pass, adjustment patterns RP of "−2," and "8" can be printed. In a sixth pass, an adjustment pattern RP of "−1" can be printed, and in a seventh pass, an adjustment pattern RP of "1" can be printed.

While omitted from the illustration, charts CT2 for adjusting the adjustment pixel distribution can be formed analogously. Assuming that ink is to be ejected in alignment with the ejection timing (DA8) set in the manner described previously, for example, in a first pass, information designating the adjustment pixels PX2 in the main scanning direction as a reference distribution AL1 is sent from the control unit 45 to the image processing unit 44, and ink is ejected from the second reference nozzles 25*c* in accordance with reference raster data DA3 with the reference distribution AL1 in question, forming a second reference pattern SP2 on the recording medium SL. Ink is also ejected from the second adjustment candidate nozzles 25*d* in accordance with reference raster data DA4 in which the adjustment pixels PX2 have been distributed in the reference distribution AL1, forming a second reference pattern RP2 of "0" on the recording medium SL. In a second pass, information for displacing the primary pixels PX1 from the reference distribution AL1 by the equivalent of 1 pixel towards the outbound direction in the main scanning direction and distributing the adjustment pixels PX2 is sent from the control unit 45 to the image processing unit 44; and ink is ejected from the second adjustment candidate nozzles 25*d* in accordance with adjustment raster data D4 in which the adjustment pixels PX2 have been distributed, forming a second adjustment pattern RP2 of "1" on the recording medium SL. In a third pass, information for displacement by the equivalent of 1+1=2 pixels and distributing the adjustment pixels PX2 is sent from the control unit 45 the image processing unit 44, forming a second adjustment pattern RP2 of "2." In a fourth pass, information displacing the primary pixels PX1 from the reference distribution AL1 by the equivalent of 1 pixel towards the return direction in the main scanning direction and distributing the adjustment pixels PX2 is sent from the control unit 45 to the image processing unit 44, and ink is ejected from the second adjustment candidate nozzles 25*d* in accordance with reference raster data DA4 in which the adjustment pixels PX2 have been distributed, forming a second adjustment pattern RP2 "−1" on the recording medium SL. In a fifth pass, information for displacement by the equivalent of 1+1=2 pixels and distributing the adjustment pixels PX2 is sent from the control unit 45 to the image processing unit 44, forming a second adjustment pattern RP2

In the case of a printer capable of Bi-d printing, adjustment charts CT are respectively furnished for outbound movement and for return movement. Because only the direction of carriage movement is reversed between outbound movement and return movement, the charts are basically identical.

The adjustment operation discussed above is performed, for example, as a step inspection in the printer manufacturing process, as one of the initialization processes when the user who has purchased the printer starts up the printer for the first time, or as a maintenance operation performed periodically by the user.

As shown in FIG. 1 A, the recording heads 23 incorporate drive elements PE1 for ejection of fluid from each of the nozzles 25. For example, when the dot value of a primary pixel PX1 is "1," voltage of a predetermined drive waveform is applied to a drive element PE1 by the head driving unit 49 to eject ink from a nozzle 25; or when the dot value of a primary pixel PX1 is "0," voltage is not applied to the drive element PE1, and ink is not ejected from the nozzle 25. As the drive elements PE1, there can be employed piezoelectric drive elements known as piezo elements; electrostatic drive elements; heaters which heat the ink and utilize pressure created by bubbles through film boiling to eject fluid from the nozzles; or the like.

Next, the dot formation positioning process will be described according to the flowchart exemplified in FIG. 13. This process is performed primarily by the control unit 45 of the printer, and starts, for example, when an operation to select a head adjustment item is made from a menu displayed on a screen, not shown, through an operation of the operation unit 53, and is performed in parallel with other processes through multitasking. Here, Step S102 corresponds to first reference pattern forming means U11 and first adjustment pattern forming means U12; Steps S104 to S110 correspond to timing setting reception means U13; Step S112 corresponds to second reference pattern forming means U21 and second adjustment pattern forming means U22; and Steps S114 to S120 correspond to distribution setting reception means U23. Hereinafter, "Step" will be omitted from the disclosure. When the dot formation positioning process starts, the control unit 45 performs a process to record adjustment charts CT1 for adjusting the ejection timing (S102). In the case of bidirectional printing performed with five recording heads #H, four adjustment charts CT1 are formed for the purpose of adjusting the ejection timing among the recording heads #H during outbound movement, and four adjustment charts CT1 are formed for the purpose of adjusting the ejection timing among the recording heads #H during return movement.

Figure 14A:
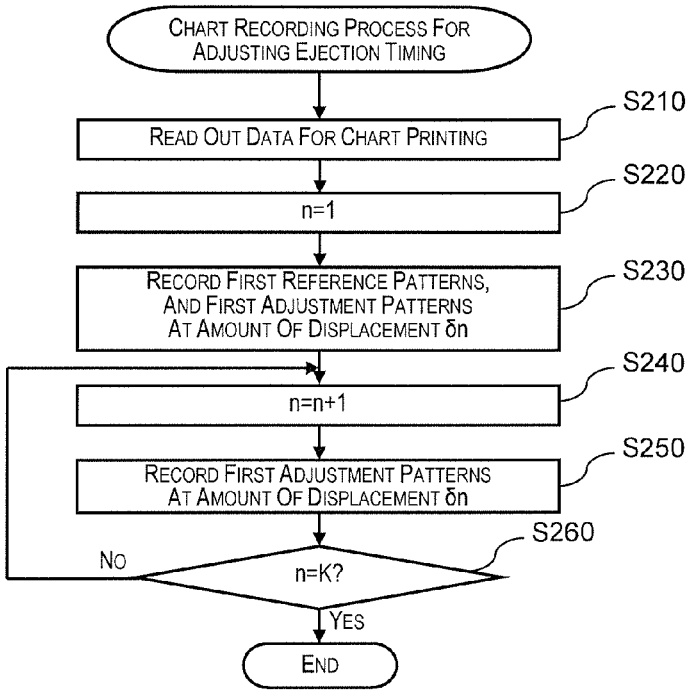
FIGS. 14 A and B are flowcharts exemplifying an adjustment chart recording process performed in the printer 11.
Figure 14B:
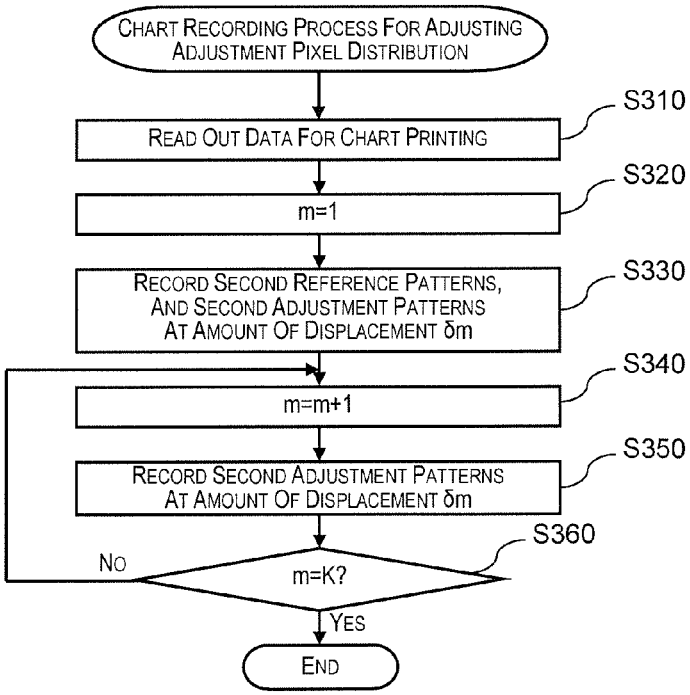

FIG. 14 A exemplifies a flowchart of a process performed in S102 to record charts for adjusting the ejection timing. This process is likewise performed primarily by the control unit 45, in parallel with other processes through multitasking. The flowchart of FIG. 14 A shows a process for recording a single type of adjustment chart CT1. Consequently, in a case of recording 4×2 types of adjustment charts CT1, the process of FIG. 14 A would be performed 4×2 times. As shall be apparent, during recording of adjustment charts at the time of outbound movement, ink is ejected from the nozzles 25 at the time of outbound movement of the carriage 21, whereas during recording of adjustment charts at the time of return movement, ink is ejected from the nozzles 25 at the time of return movement of the carriage 21.

When the chart recording process starts, the control unit 45 reads out data for printing a chart for adjustment of ejection timing from the nonvolatile memory 47 (S210). This data for chart printing is data for the purpose of forming the adjustment charts CT1 shown in FIG. 8 A on the recording medium SL. In S220, the counter n is set to an initial value of "1." n corresponds to the number of passes during printing of the adjustment pattern, and is used for the purpose of determining an amount of displacement δ of the patterns.

In S230, based on the aforedescribed data for chart printing, first reference patterns SP1, as well as first adjustment patterns RP1, are recorded at amounts of displacement δ on the recording medium SL. As shown in FIG. 11, in a first pass, for example, the first reference patterns SP1, as well as three first adjustment patterns RP1 at amounts of displacement of "−10, 0, 10," can be recorded. Here, the first reference patterns SP1 are patterns formed on the recording medium SL through ejection of ink at a reference ejection timing TM1 from the first reference nozzles 25*a* (for example, the nozzle row #1A) of a reference recording head (for example, #1). Formation of the first reference patterns SP1 corresponds to the first reference pattern forming means U11. The first adjustment patterns RP1 are patterns formed on the recording medium SL through ejection of ink from the first adjustment candidate nozzles 25*b* at an adjustment ejection timing TM2 with reference to the reference ejection timing TM1, when at least a portion of the nozzles in recording heads #Hr excluding the reference recording head #Hs are designated as the first adjustment candidate nozzles 25*b* (for example, nozzle row #5B). Formation of the first adjustment patterns RP1 corresponds to the first adjustment pattern forming means U12.

In S240, the counter n is increased to "1." In S250, based on the aforedescribed data for chart printing, first adjustment patterns RP1 are recorded at amounts of displacement δm on the recording medium SL. For example, in the second pass of FIG. 11, two first adjustment patterns RP1 at amounts of displacement of "−8, 2" can be recorded. As shall be apparent, this formation of the first adjustment patterns RP1 also corresponds to the first adjustment pattern forming means U12.

In S260, it is decided whether the counter n has reached K. Here, K is an integer equal to 2 or greater, and corresponds to the number of passes needed to print the first adjustment patterns RP1. If not true that n=K, the control unit 45 returns the process to S240, or if true that n=K, terminates the chart recording process.

Figure 13:
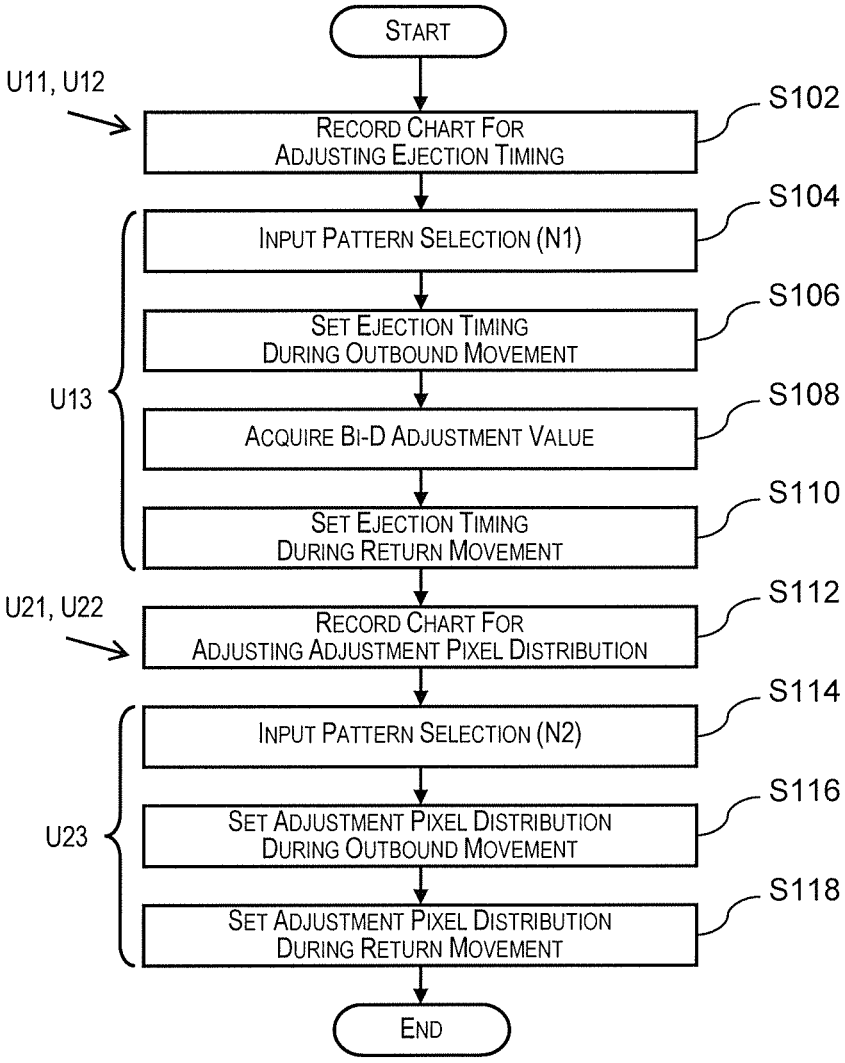
FIG. 13 is a flowchart exemplifying a dot formation positioning process performed in the printer 11.

Once the adjustment charts CT1 like those shown in FIG. 8 A have been formed in the aforedescribed chart recording process, the control unit 45 receives, for example, from the operation unit 53 or the host device HC, inputs for selecting a pattern combination PG1 (S104 of FIG. 13). The user, while looking at the combinations PG1, can manually input through the operation unit 53, etc., numerical values (information) N1 that correspond to the first adjustment patterns RP1 having the smallest position displacement with respect to the first reference patterns SP1. In a case where 4×2 adjustment charts CT1 have been recorded, eight numerical values would be input.

In S106, in accordance with the information that was input in S104, timing adjustment data DA8 that represents ejection timing for bringing the positions of dots DT1 formed by the first adjustment candidate nozzles 25*b* in the direction of relative movement DR1 during outbound movement into alignment with the positions of dots DT1 formed by the first reference nozzles 25*a* is generated and stored in the nonvolatile memory 47. In a case in which a numerical value of "2" has been selected in the adjustment chart CT1 of FIG. 8 A, timing adjustment data DA8 that represents an ejection timing corresponding to a numerical value of "2" is generated.

In S108, a Bi-d adjustment value is obtained. The process of S108 can be a process of reading out a preset Bi-d adjustment value R1 from the nonvolatile memory 47, for example. The Bi-d adjustment value R1 can be one obtained, for example, as shown in FIG. 9 A using the reference nozzle row in the reference recording head, by selecting the pattern having the smallest displacement from among Bi-d adjustment patterns that have been printed out while varying the combination of delay values (i.e., the amount of displacement representing the differential of the combination of delay values) during outbound movement and return movement, and setting the value to the adjustment value R1 that corresponds to the selected pattern.

In S110, in accordance with the information that was input in S104 and the aforedescribed Bi-d adjustment value R1, timing adjustment data DA8 that represents ejection timing for bringing the positions of dots DT1 formed by the first adjustment candidate nozzles 25*b* in the direction of relative movement DR1 during return movement into alignment with the positions of dots DT1 formed by the first reference nozzles 25*a* is generated and stored in the nonvolatile memory 47. In a case in which a numerical value of N1 has been selected in the adjustment chart CT1 of FIG. 8 A, through the addition of the Bi-d adjustment value R1, timing adjustment data DA8 that represents adjustment ejection timing TM2 corresponding to the numerical value N1 is generated. By the process of S104 to S110 discussed previously, the printer 11 receives a setting of an ejection timing for bringing into alignment the positions of the dots DT1 formed by both the nozzles 25*a* and 25*b* in the direction of relative movement DR1.

In S112, a process to record adjustment charts CT2 for adjusting adjustment pixel distribution is performed. In a case in which bidirectional printing is performed with five recording heads #H, four adjustment charts CT2 for adjusting ejection timing among the recording heads #H during outbound movement are formed, and four adjustment charts CT2 for adjusting ejection timing among the recording heads #H during return movement are formed.

FIG. 14 B exemplifies a flowchart of a process for recording a chart for adjusting the adjustment pixel distribution, performed in S112. This process is likewise performed primarily by the control unit 45, in parallel with other processes through multitasking. The flowchart of FIG. 14 B shows a process for recording a single type of adjustment chart CT2. Consequently, in a case of recording 4×2 types of adjustment charts CT1, the process of FIG. 14 B would be performed 4×2 times. As shall be apparent, during recording of adjustment charts at the time of outbound movement, ink is ejected from the nozzles 25 at the time of outbound movement of the carriage 21, whereas during recording of adjustment charts at the time of return movement, ink is ejected from the nozzles 25 at the time of return movement of the carriage 21.

When the chart recording process starts, the control unit 45 reads out data for printing a chart for adjusting the adjustment pixel distribution, from the nonvolatile memory 47 (S310). This data for chart printing is data for the purpose of forming the adjustment charts CT2 shown in FIG. 8 B on the recording medium SL. In S320, the counter m is set to an initial value of "1." m corresponds to the number of passes during printing of the adjustment pattern, and is used for the purpose of determining an amount of displacement δ of the pattern.

In S330, information designating the adjustment pixels PX2 in the main scanning direction as a reference distribution AL1 is sent to the image processing unit 44, and based on the aforedescribed data for chart printing, second reference patterns SP2 and second adjustment patterns RP2 with amounts of displacement δm are recorded onto the recording medium SL. In a first pass, for example, the second reference patterns SP2 and a second adjustment pattern RP2 with an amount of displacement δm of "0" can be recorded.

Here, the second reference patterns SP2 are patterns formed on the recording medium SL through ejection of ink from the second reference nozzles 25*c* (for example, the nozzle row #1B) in a reference recording head (for example, #1) in accordance with the aforedescribed set ejection timing (DA8). The second reference patterns SP2 are patterns in accordance with reference raster data DA3 in which the adjustment pixels PX2 are positioned according to the reference distribution AL1 in the direction of relative movement DR1. Formation of the second reference patterns SP2 corresponds to the second reference pattern forming means U21. The second adjustment patterns RP2 are patterns formed on the recording medium SL through ejection of ink from the second adjustment candidate nozzles 25*b* in accordance with the aforedescribed set ejection timing (DA8), when at least a portion of the nozzles in recording heads #Hr excluding the reference recording head #Hs are designated as the second adjustment candidate nozzles 25*d* (for example, nozzle row #5A). The second adjustment patterns RP2 are patterns in accordance with adjustment raster data DA4 in which the adjustment pixels PX2 are positioned according to the reference distribution AL1 in the direction of relative movement DR1. Formation of the second adjustment patterns RP2 corresponds to the second adjustment pattern forming means U22.

In S340, the counter m is increased to "1." In S350, based on the aforedescribed data for chart printing, second adjustment patterns RP2 are recorded at amounts of displacement δm on the recording medium SL. For example, in the second pass, information for displacing the primary pixels PX1 from the reference distribution AL1 by the equivalent of 1 pixel towards the outbound direction in the main scanning direction and distributing the adjustment pixels PX2 is sent to the image processing unit 44. Based on the aforedescribed data for chart printing, second adjustment patterns RP2 are recorded at amounts of displacement δm on the recording medium SL. As shall be apparent, this formation of the second adjustment patterns RP2 also corresponds to the second adjustment pattern forming means U22.

In S360, a judgment is made as to whether the counter m has reached K. Here, K is an integer equal to 2 or greater, and corresponds to the number of passes needed to print the second adjustment patterns RP2. If it is not true that m=K, the control unit 45 returns the process to S340. On the other hand, if m=K, the control unit terminates the chart recording process.

Once the adjustment charts CT2 like those shown in FIG. 8 B have been formed in the aforedescribed chart recording process, the control unit 45 receives inputs for selecting a pattern combination PG2 from the operation unit 53 or the host device HC, for example (S114 of FIG. 13). The user, while looking at the combinations PG2, can manually input through the operation unit 53 or the like, numerical values (information) N2 that correspond to the second adjustment patterns RP2 having the smallest position displacement with respect to the second reference patterns SP2. In a case where 4×2 adjustment charts CT2 have been recorded, eight numerical values would be input.

In S116, in accordance with the information that was input in S114, distribution data DA9 that represents a distribution of adjustment pixels PX2 for bringing the positions of dots DT1 formed by the second adjustment candidate nozzles 25*d* in the direction of relative movement DR1 during outbound movement into alignment with the positions of dots DT1 formed by the second reference nozzles 25*c* is generated and stored in the nonvolatile memory 47. In a case in which a numerical value of "0" has been selected in the adjustment chart CT2 of FIG. 8 B, distribution data DA9 that represents an adjustment distribution AL2 corresponding to a numerical value of "0" is generated. In a case in which a numerical value of "1" has been selected, distribution data DA9 that represents an adjustment distribution AL2 corresponding to a numerical value of "1" is generated.

In S118, in accordance with the information that was input in S114, distribution data DA9 is generated and stored in the nonvolatile memory 47, and this distribution data represents a distribution of adjustment pixels PX2 for bringing the positions of dots DT1 formed by the second adjustment candidate nozzles 25*d* in the direction of relative movement DR1 during return movement into alignment with the positions of dots DT1 formed by the second reference nozzles 25*c*. In a case in which a numerical value of N2 has been selected in the adjustment chart CT1 of FIG. 8 B, distribution data DA9 that represents an adjustment distribution AL2 corresponding to a numerical value of "N2" is generated. By the processes of S114 to S118 discussed previously, the printer 11 receives a setting of a distribution of adjustment pixels PX2 for bringing the positions of dots DT1 formed by the second adjustment candidate nozzles 25*d* in the direction of relative movement DR1 into alignment with the positions of dots DT1 formed by the second reference nozzles 25*c*.

Once the ejection timing and adjustment pixel distribution have been set, position displacement of dots is compensated for through adjustment of ejection timing in recording head 23-equivalent units, whereas for the nozzle rows constituting the recording heads 23, position displacement of dots is compensated for through the adjustment pixel distribution.

As shown in FIG. 4, print data having the raster data DA1, when input to the I/F 41 from the host device HC, is then input to the image processing unit 44 through the reception buffer 42. In accordance with the adjustment pixel distribution information represented by the distribution data DA9, the image processing unit 44 generates adjusted raster data DA2 by way of data in which the adjustment pixel data DA12 of the raster data DA1 is represented as adjustment pixels PX2 in response to the distribution data DA9, as shown in FIG. 5. This adjusted raster data DA2 is sent to the head driving unit 49 via the image buffer 46. Meanwhile, in accordance with delay setting values Dc based on the timing adjustment data DA8, the print timing signal generating circuit 48 generates a print timing signal PTS that represents timing in response to the timing adjustment data DA8, and supplies the signal to the head driving unit 49. As a result, the head driving unit 49 ejects ink from the plurality of nozzles 25 in accordance with the adjusted raster data DA2, in a manner coincident with the ejection timing represented by the timing adjustment data DA8. An image corresponding to the print data is formed on the recording medium SL.

In the preceding manner, the present printer 11 ejects ink according to a set ejection timing (DA8) to thereby compensate for position displacement of dots in recording head 23-equivalent units, whereupon, for the nozzles 25 constituting the recording heads 23, position displacement of dots is compensated for by the adjustment pixels PX2 of the set distribution according to position adjustment corresponding to the direction of relative movement DR1 of the primary pixel data DA11 within the raster data DA1.

In cases in which the ejection timing (DA8) cannot be adjusted in recording head 23-equivalent units, even if the positional accuracy of dot DT1 is good for a first nozzle at a given position in the direction of relative movement DR1 in a recording head 23, a second nozzle at a different position in the direction of relative movement DR1 within the same recording head 23 can experience lower dot DT1 positional accuracy than the first nozzle. In the present technique, as exemplified in FIGS. 1 A to D, for the nozzles 25 making up the recording heads 23, even in cases in which position displacement GA1 of dots DT1 cannot be adequately compensated through ejection timing (DA8) in recording head 23-equivalent units, position displacement GA3 of the dots DT1 can be compensated through a distribution of the adjustment pixels PX2 constituting the raster data DA1. Consequently, there is an improvement in positional accuracy in the direction of relative movement DR1 of dots DT1 formed by the fluid ejection device 11 in which the plurality of recording heads 23 respectively have a plurality of nozzles 25 at different positions in the direction of relative movement DR1. In cases in which an image is being formed on the recording medium SL, picture quality of the image can be improved.

Also, because the smallest unit in which dot formation position is adjustable through adjustment of the ejection timing is smaller than the pixel pitch x in the direction of relative movement DR1, there is good positional accuracy of dots in the direction of relative movement DR1.

Figure 15:
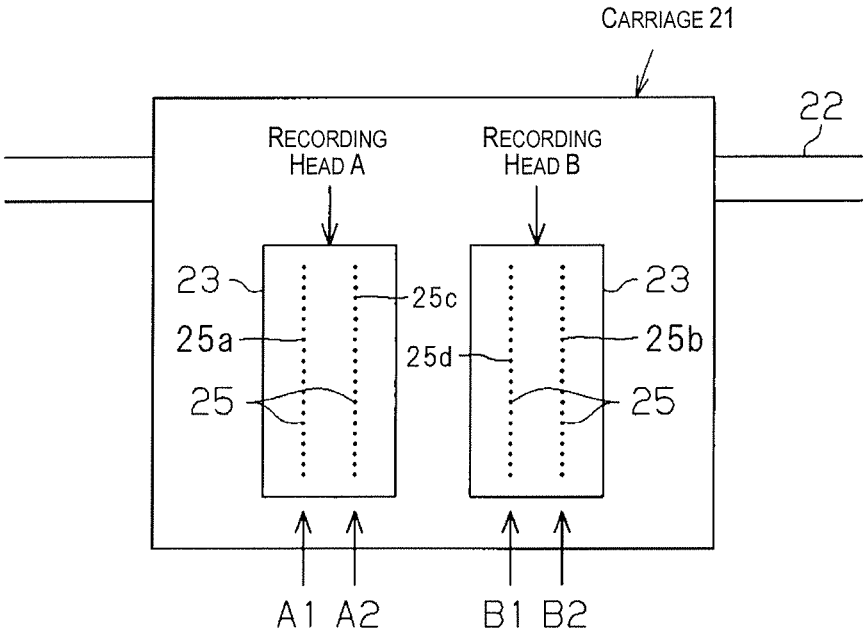
FIG. 15 is view schematically showing a bottom surface of a carriage 21 in a modified example.

Various devices can be employed as the fluid ejection device, such as the fluid ejection device provided with the carriage 21 exemplified in FIG. 15. On the bottom surface of the carriage 21 of FIG. 15, recording heads A and B divided into two are assembled. A row A1 of first reference nozzles 25*a* for ejecting Y ink and a row A2 of second reference nozzles 25*c* for ejecting M ink are formed in the recording head A. A row B1 of second adjustment candidate nozzles 25*d* for ejecting C ink and a row B2 of first adjustment candidate nozzles 25*b* for ejecting K ink are formed in the recording head B. In this example, the positions of dots formed by nozzle rows of the same color included in the different recording heads are not brought into alignment; however, image quality of formed images can be improved by bringing into alignment the positions of dots formed by nozzle rows of the same color included in different recording heads.

(3) Second Embodiment

Next, a second embodiment is described with reference to FIGS. 16 A and B. The present embodiment differs from first embodiment in that optimum adjustment values are set automatically by performing analysis of images of the adjustment charts CT1, CT2 scanned by scanning means (81, 82).

Figure 16A:
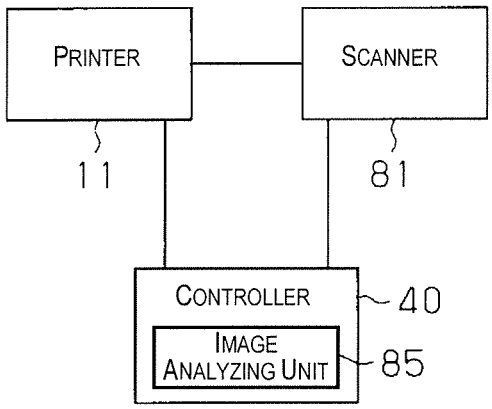
FIG. 16 A is a block diagram exemplifying the printer 11 and a scanner 81, and B is a perspective view schematically exemplifying a printer equipped with a reading sensor.
Figure 16B:
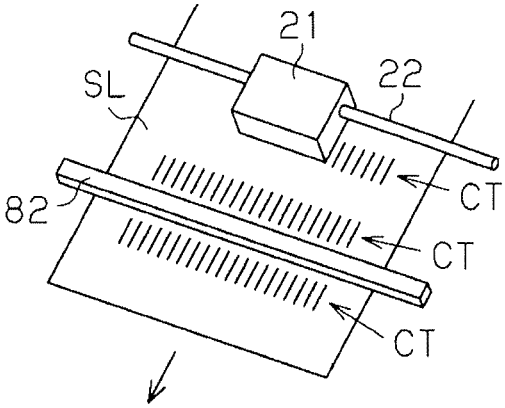

In the recording system exemplified in FIG. 16 A, the printer 11, a scanner 81, and the controller 40 are connected to one another. As shall be apparent, the printing system could also be a multifunction device in which the scanner 81 is furnished in integrated fashion to the printer 11, or the like.

The scanning sensor-equipped printer exemplified in FIG. 16 B is furnished to the downstream side in the conveying direction from the travel area of the carriage 21 with an image sensor 82 having a length such that the printing surface of a sheet of recording medium SL is scannable across the entire widthwise direction of the recording medium SL. The image sensor 82 has, for example, a plurality of CCD elements arrayed along the widthwise direction of the recording medium SL. As shall be apparent, the patterns printed onto the recording medium SL could also be scanned by an image sensor installed on the carriage 21, in the course of movement of the carriage 21 in the main scanning direction.

Chart image data obtained through scanning of adjustment charts CT by the scanning means (81, 82) is held in the reception buffer 42 within the controller 40. An image analyzing unit 85 furnished within the control unit 45 of the controller 40 performs image analysis of the chart image data read from the reception buffer 42, identifies a group of patterns (PG) with the highest degree of alignment of the reference patterns SP and the adjustment patterns RP, and acquires adjustment values corresponding to the pattern combination PG in question. From adjustment values obtained from adjustment charts CT1 exemplified in FIG. 8 A, the control unit 45 generates timing adjustment data DA8; and from adjustment values obtained from adjustment charts CT2 exemplified in FIG. 8 B, generates distribution data DA9. In the preceding manner, in the invention, optimal print timing of a plurality of recording heads 23 can be set automatically.

The printer 11 generates adjusted raster data DA2 as data in which adjustment pixel data DA12 of raster data DA1 is represented by adjustment pixels PX2 in a distribution represented by distribution data DA9; and ejects ink from the plurality of nozzles 25 in accordance with the adjusted raster data DA2 in alignment with the ejection timing represented by the timing adjustment data DA8. Consequently, in the direction of relative movement, the positional accuracy of dots formed by the printer 11 is improved.

(4) Third Embodiment

Next, a third embodiment in which the present technique takes the form of an inkjet recording line printer is described with reference to FIGS. 17 and 18.

Figure 17:
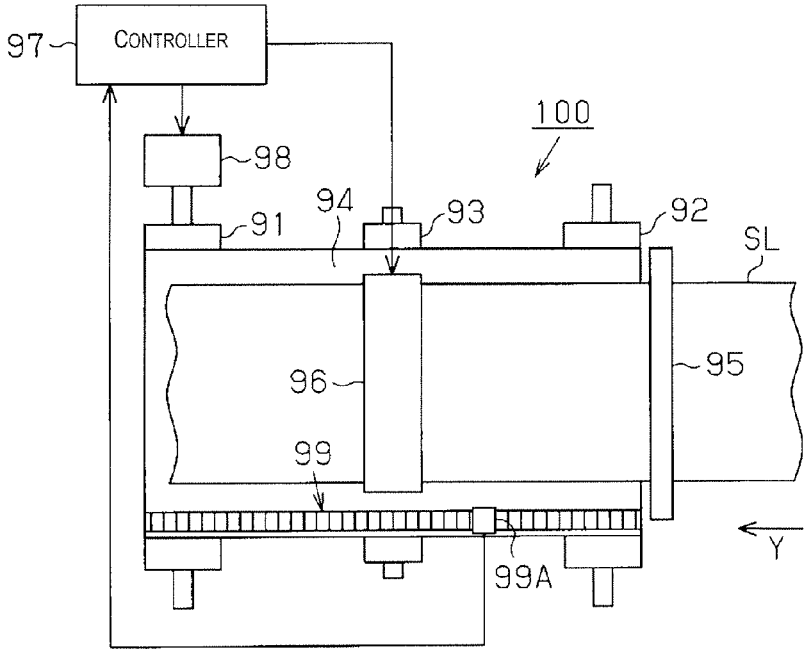
FIG. 17 is a plan view schematically exemplifying a line printer 100.

In a line printer 100 exemplified in FIG. 17, a sheet of recording medium SL is introduced via a roller 95 onto a conveyor belt 94 which is looped around a plurality of rollers 91 to 93. A recording unit 96 is disposed in an approximately center portion in the conveying direction of the conveyor belt 94. This recording unit 96 is positioned above the conveyor belt 94 (towards the viewer in a direction orthogonal to the plane of the page in FIG. 17), at a predetermined gap from the belt surface thereof.

Figure 18:
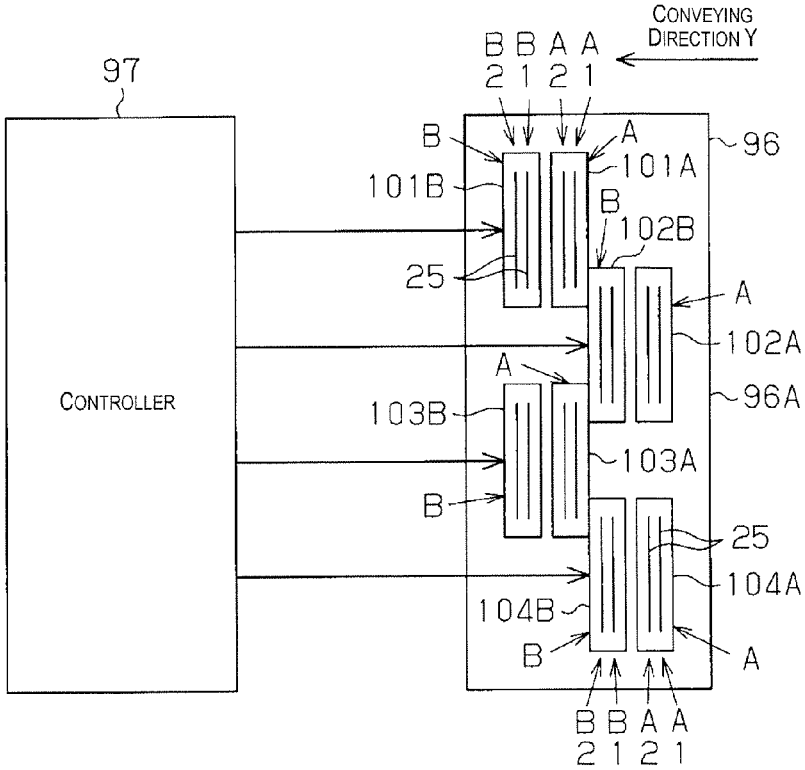
FIG. 18 is a view schematically exemplifying a controller 97 and a recording head of line recording format.

As exemplified in FIG. 18, the recording unit 96 is a so-called multi-head type recording unit in which a plurality of recording heads are disposed across the entire maximum width of the paper. A controller 97 shown in FIG. 17 conveys the recording medium SL at a constant speed towards the downstream side in a conveying direction Y (towards the left side in FIG. 17) on the conveyor belt 94 through driving of a conveying motor 98. A linear encoder 99 is furnished at a side edge of the conveyor belt 94, and the ejection timing of recording heads 101A to 104A and 101B to 104B is controlled by the controller 97 on the basis of an ejection timing signal generated from encoder pulses output by a sensor 99A of the linear encoder 99.

As shown in FIG. 18, the recording heads 101A to 104A and 101B to 104B which are furnished to the bottom surface side of a chassis 96A of the recording unit 96 are arrayed in a total of four groups in a staggered disposition, with two heads adjacently disposed in the conveying direction Y (direction of relative movement DR1) in each single group. The recording heads 101A to 104A, 101B to 104B are electrically connected to the controller 97 which is identical to the controller 40 of the first embodiment, and spraying thereof is controlled by the controller 97.

In the recording heads 101A to 104A that are positioned to the upstream side in the conveying direction, there are formed a row A1 of first reference nozzles for ejecting Y ink, and a row A2 of second reference nozzles for ejecting M ink. In the recording heads 101B to 104BA that are positioned to the downstream side in the conveying direction, there are formed a row B1 of second adjustment candidate nozzles for ejecting C ink, and a row B2 of first adjustment candidate nozzles for ejecting K ink. Consequently, as in the first embodiment, position displacement of dots can be compensated for in recording head-equivalent units by acquiring adjustment values for adjusting the ejection timing which are composed of a first reference pattern by ink ejection from the row A1 and a first adjustment pattern by ink ejection from the row B2, and adjusting the ejection timing of the recording heads A, B. Also, position displacement of dots that cannot be adequately compensated for in recording head-equivalent units can be compensated for by acquiring adjustment values for adjusting the adjustment pixel distribution which are composed of a second reference pattern by ink ejection from the row A2 and a second adjustment pattern by ink ejection from the row B1 and adjusting the adjustment pixel distribution.

As shall be apparent, the number of recording heads disposed in the conveying direction Y can be three or more, as in the head section HE1 exemplified in FIG. 1 A.

(5) Fourth Embodiment

Figure 19:
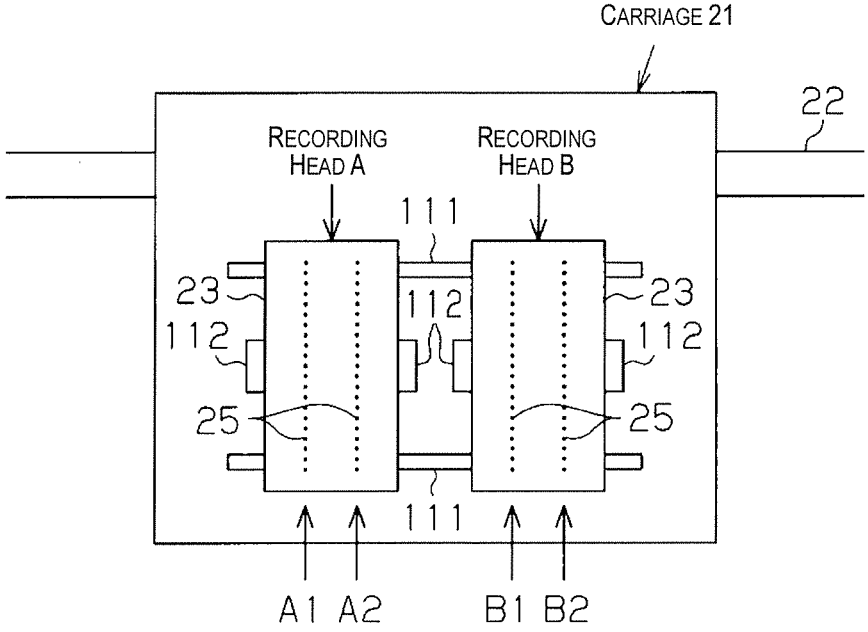
FIG. 19 is view schematically showing a bottom surface of a carriage 21 in a modified example.

As shown in FIG. 19, adjustment of the ejection timing can be performed through adjustment of the positional relationships of the plurality of recording heads. In the carriage 21 shown in FIG. 19, a plurality of recording heads A, B are attached in a moveable state in the main scanning direction (direction of relative movement DR1) guided by guide rails 111. The recording heads A, B are respectively furnished with actuators 112 making possible for them to be moved (displaced) in the main scanning direction X. For example, piezoelectric actuators that drive through electrostrictive action, or the like can be used as the actuators 112. In cases where limited ability to make adjustments through delay setting values Dc is conceivable, first, the actuators 112 can be driven to make rough adjustment of the relative positions of the recording heads A, B in the main scanning direction X, the adjustment charts CT1 can be reprinted if necessary, and numerical values corresponding to the optimal group of patterns (PG) are then acquired. As part of the timing adjustment data DA8, the adjustment unit 61 can set adjustment values calculated on the basis of the acquired numerical values.

(6) Fifth Embodiment

Figure 20:
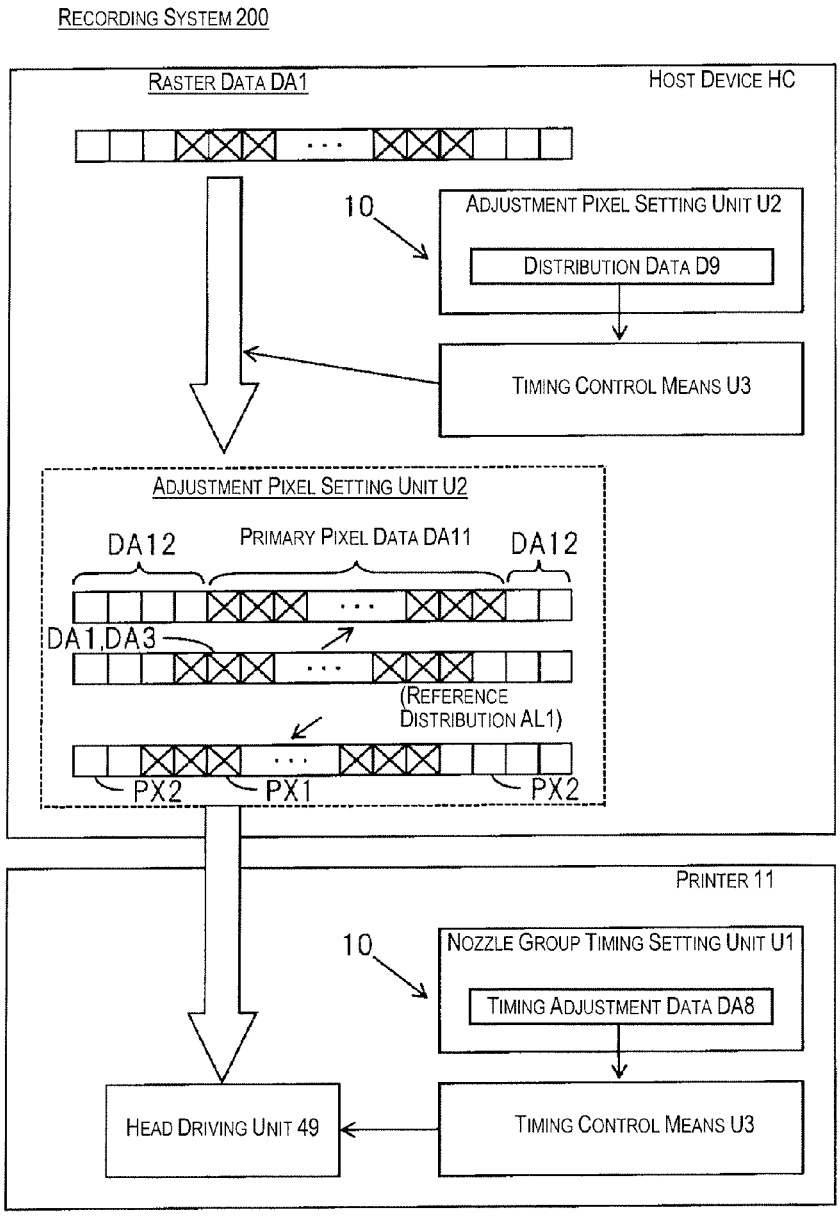
FIG. 20 is a block diagram showing a recording system 200 in a modified example.

As with the recording system 200 exemplified in FIG. 20, the dot formation positioning device 10 can be furnished in distributed fashion to the fluid ejection device (printer 11) and the host device HC. The host device HC of the present example is provided with an adjustment pixel setting unit U2 and timing control means U3 for the host side. This host-side timing control means U3 generates adjusted raster data DA2 as data in which the adjustment pixel data DA12 of the raster data DA1 is represented as adjustment pixels PX2 in a distribution (DA9) set by the adjustment pixel setting unit U2. This adjusted raster data DA2 is transmitted to the printer 11.

The printer 11 of the present example is provided with a nozzle group timing setting unit U1 and printer-side timing control means U3. While the functions corresponding to the adjustment pixel setting unit U2 and the host-side timing control means U3 are not needed in the printer 11, these can be furnished to the printer 11. The printer-side timing control means U3 performs control to eject the fluid FL1 from the plurality of nozzles 25 in accordance with the adjusted raster data DA2, in alignment with the ejection timing (DA8) which has been set by the nozzle group timing setting unit U1. In the preceding manner, the present recording system 200 affords good positional accuracy in the direction of relative movement DR1 of dots formed by the printer 11 in which the plurality of nozzle groups (23) have their respective nozzles 25 in respectively different positions in the direction of relative movement DR1.

(7) Sixth Embodiment

The fluid ejection device can have a plurality of dot formation modes in response to the resolution, recording speed, number of recording passes, type of recorded image, type of recording medium, and the like. In this case, pattern forming means U11, U12, U21, U22 can eject the fluid FL1 of a particular color or colors in response to the dot formation mode from the nozzles 25 for ejecting the color or colors in question, to form reference patterns SP1, SP2 or adjustment patterns RP1, RP2 on the recording medium SL.

For example, as resolution dot formation modes, there can be furnished resolution dot formation modes such as high resolution mode (for example, 2880×1440 dpi), medium resolution mode (for example, 1440×720 dpi), low resolution mode (for example, 730×360 dpi), and the like. Recording speed dot formation modes have a tradeoff relationship with resolution, and the high resolution mode, medium resolution mode, and low resolution mode can be interpreted respectively as a high picture quality mode, a normal mode, and a high speed mode. As number of recording pass modes, there can be furnished number of pass modes such as single-pass mode in which dots of a single raster are formed during a single pass, two-pass mode in which dots of a single raster are formed during two passes, and the like. Because recording speed is dependent on the number of recording passes as well, single-pass mode can be interpreted as high speed mode, and two-pass mode as normal mode.

The quality of recorded images depends on the resolution, the recording speed, the number of recording passes, and the like. Thus, dot formation modes in which the resolution, the recording speed, the number of recording passes, etc., are set in response to the type of recorded image can be furnished in response to the type of recorded image. For example, in a case where recorded images are primarily photos, it would be conceivable to adopt a setting to form dots of a single raster during two passes or the like, in order to minimize color irregularities. In a case where recorded images are primarily text, it would be conceivable to adopt a setting to form dots of a single raster during a single pass or the like, in order to form dots at high speed. Also, the quality of images formed on a recording medium is dependent upon the type of recording medium. Thus, in accordance with the type of recording medium, it is possible to provide dot formation modes in which the resolution, the recording speed, the number of recording passes, and the like are set in response to the type of recording medium. For example, in a case where coated paper such as glossy paper and the like, known as photo paper, is used, it would be conceivable to adopt a setting to form dots of a single raster during two passes or the like, in order to minimize color irregularities. In a case where non-coated paper such as plain paper, recycled paper, or the like is used, it would be conceivable to adopt a setting to form dots of a single raster during a single pass, or the like, in order to form dots at high speed.

Figure 21A:
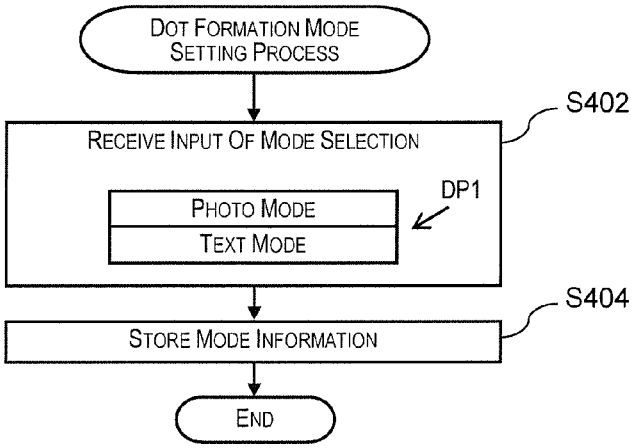
FIGS. 21 A and B are flowcharts of processes in a modified example.
Figure 21B:
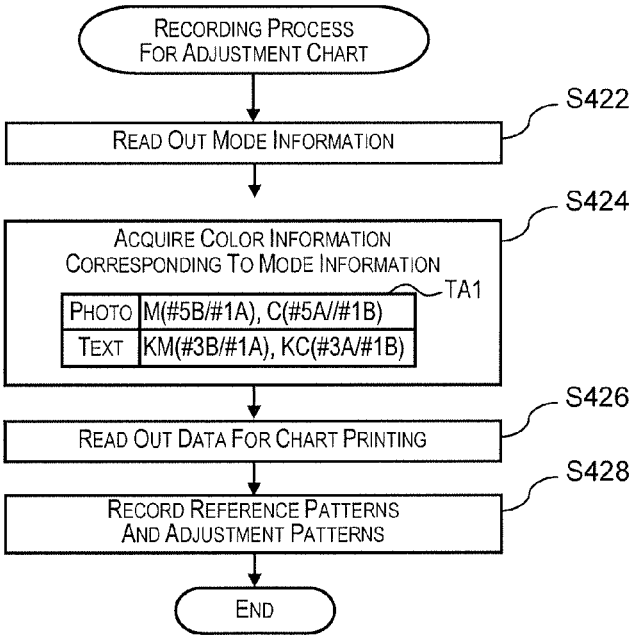

FIG. 21 A utilizes a flowchart to exemplify a process whereby a fluid ejection device (printer 11) sets the aforedescribed dot formation modes. This process is primarily performed by the control unit 45 of the printer, and is started, for example, by an operation to select a mode selection item from a menu displayed on a screen, not shown, through an operation of the operation unit 53, and is performed in parallel with other processes through multitasking. The dot formation mode setting process can also be carried out by the host device HC.

When the dot formation mode setting process starts, the control unit 45 displays a mode selection screen DP1 on the operation unit 53, and receives input of an operation for selecting a dot formation mode from among any of a plurality of dot formation modes (S402). As shown in FIG. 21 A, dot formation mode items such as, for example, photo mode, text mode, and the like are displayed on the mode selection screen DP1. Here, the photo mode is a setting for forming primarily photo images in two-pass mode or the like, and the text mode is a setting for forming primarily text images in single-pass mode or the like. The control unit 45 then stores dot information representing the received dot formation mode in the nonvolatile memory 47, etc. (S404), and terminates the dot formation mode setting process.

FIG. 21 B utilizes a flowchart to exemplify an adjustment chart recording process for chart formation which assigns precedence to patterns of color in response to the dot formation mode. This process is one performed in S102 and S112 of FIG. 13, and is primarily performed by the control unit 45 of the printer, in parallel with other processes through multitasking. The process is premised on using the nonvolatile memory 47 or the like to store a formation color table TA1, which is an information table associating dot formation modes with pattern colors (including combinations of colors). In the formation color table TA1 shown in FIG. 21 B, "M (#5B/#1A)" (M of nozzle row #5B with respect to M of nozzle row #1A) and "C (#5A/#1B)" (C of nozzle row #5A with respect to C of nozzle row 41B) are associated with the photo mode. Employing chromatic color (including combinations of colors) of relatively low brightness for bringing dot positions into alignment is favorable in terms of increasing the picture quality of formed images such as photos, in which high picture quality of chromatic color can be readily anticipated. On the other hand, "KM (#3B/#1A)" (K of nozzle row #3B with respect to M of nozzle row #1A) and "KC (#3A/#1B)" (K of nozzle row #3A with respect to C of nozzle row #1B) are associated with text mode. Employing achromatic color (including combinations of colors) of relatively low brightness for bringing dot positions into alignment is favorable in terms of increasing the picture quality of formed images such as text, in which high picture quality of achromatic color of relatively low brightness can be readily used.

Like the photo mode, the high resolution mode with a relatively high resolution setting, the high picture quality mode with a relatively slow recording speed setting, and the multi-pass mode with a relatively high number of passes setting can be associated with color (including combinations of colors) of chromatic color of relatively low brightness such as "M (#5B/#1A)" and "C (#5A/#1B)," and the like. Like the text mode, resolution modes with resolution settings lower than the aforedescribed high resolution mode, recording speed modes with faster recording speed settings than the aforedescribed high picture quality mode, and pass modes with a fewer number of passes settings than the aforedescribed multi-pass mode with a relatively high number of pass setting can be associated with color (including combinations of colors) including achromatic color of relatively low brightness such as "KM (#3B/#1A)" and "KC (#3A/#1B)," and the like.

When the adjustment chart recording process starts, the control unit 45 reads the aforedescribed mode information from the nonvolatile memory 47 or the like (S422). In S424, color information corresponding to the read out mode information is acquired by referring to the formation color table TA1. For example, in a case in which the mode information is the photo mode, M (#5B/#1A)" and "C (#5A/#1B)" is acquired. In S426, chart printing data is read out from the nonvolatile memory 47. In a case in which ejection timing is to be adjusted, chart printing data for adjustment of ejection timing is read out, or in a case in which adjustment pixel distribution is to be adjusted, chart printing data for adjustment of the adjustment pixel distribution is read out.

The control unit 45 then forms reference patterns and adjustment patterns corresponding to the acquired color (including combinations of colors) on the recording medium SL (S428), and terminates the adjustment chart recording process. In a case in which ejection timing is being adjusted, a process like that shown in S220 to S260 of FIG. 14 A is performed, while recording the first reference patterns SP1, and the first adjustment patterns RP1 at amounts of displacement 8*n*. In a case in which adjustment pixel distribution is being adjusted, a process like that shown in S320 to S360 of FIG. 14 B is performed, while recording second reference patterns SP2, and second adjustment patterns RP2 at amounts of displacement δm. As shall be apparent in photo mode, precedence is given to formation of M patterns SP1, RP1 and C patterns SP2, RP2. In text mode, precedence is given to formation of M first reference patterns SP1 and K first adjustment patterns RP1, and to C second reference patterns SP2 and K second adjustment patterns RP2.

Once the adjustment chart recording process is terminated, the ejection timing and the adjustment pixel distribution can be set by performing processing like that shown in S104 to S110 and S114 to S118 of FIG. 13. Specifically, in photo mode, high resolution mode, high picture quality mode, and multi-pass mode, chromatic color is favorable in terms of increasing the picture quality because high picture quality can be readily anticipated. In text mode, resolution modes with relatively low resolution settings, recording speed modes with relatively fast recording speed settings, and pass modes with relatively few number of passes settings, achromatic color of relatively low brightness is favorable in terms of increasing the picture quality because high picture quality can be readily anticipated.

(8) Modified Examples

The embodiments discussed above can be modified to aspects such as the following. The step sequence of the processes discussed above can be modified as appropriate. For example, in FIG. 13, setting of the ejection timing during outbound movement in S106 can be performed after setting of the ejection timing during return movement in S110; and setting of the adjustment pixel distribution during outbound movement in S116 can be performed after setting of the adjustment pixel distribution during return movement in S118. Adjustment of the ejection timing or adjustment pixel distribution can be performed during outbound movement only, or during return movement only. The present technique also includes cases in which there are three or more nozzle groups, and the ejection timing is adjusted for only a portion of the nozzle groups.

It is merely necessary for the plurality of nozzle groups into which the plurality of nozzles have been demarcated to constitute the unit of control by the unit for determining the ejection timing, such as the print timing signal generating circuit 48, and the nozzle group is not limited to divided recording heads. For example, there are recording heads that are divided into four or more, and in cases where the unit for determining the ejection timing controls the recording heads in units equivalent to two heads, the two recording heads would constitute a single nozzle group. If a recording head is not divided, in cases where the unit for determining the ejection timing controls the nozzle rows in units equivalent to p nozzle rows (p is an integer equal to 1 or greater), p nozzle rows would constitute a single nozzle group. The present technique also includes instances in which the nozzles furnished to each of the nozzle groups are disposed in an arrangement other than two rows, such as in three or more rows, or in some state not described as rows. The present technique also includes cases in which there are three or more nozzle groups, with positions of dots from nozzles that eject ink of the same color in three or more nozzle groups being brought into alignment. As shall be apparent, the colors of the fluids ejected from the nozzles are not limited to C, M, Y, K, Lk as discussed above, and can be various other colors such as light cyan (Lc), light magenta (Lm), dark yellow (DY), or LLk lighter than Lk, or colorless, etc. The present technique is applicable as well in cases where fluid of the same color is ejected from all of the nozzles, such as in a single-color device.

The patterns discussed above can vary in shape and number. For example, the shapes of the patterns can be polygonal other than rectangular, elliptical, or the like. There can be one reference pattern, two, or four or more. There can be one adjustment pattern, or three or more. Various combinations can be adopted as combinations of the reference patterns and adjustment patterns. Provided that the relative positional relationships of the reference patterns and adjustment patterns are discernibly different, it is possible to employ patterns of any shape and number.

A configuration whereby the recording timing of each of the recording heads can be varied when the recording heads and the recording medium move in relative fashion one time (for example, one pass) can be employed as well. According to such a configuration, the number of passes needed to print the adjustment charts can be reduced.

Besides paper, the recording medium can be a resin sheet, a metal film, cloth, a film substrate, a resin substrate, a semiconductor wafer, a storage medium such as an optical disk or magnetic disk, or the like. The recording medium can take the form of a material of continuous length, or of cut sheets known as cut paper, a three-dimensional shape, or the like.

Besides an inkjet printer, the printer can be a dot impact printer, a laser printer, or the like. As fluid ejection devices in which the invention is implementable, besides printers, liquid ejection devices provided with liquid ejection heads or the like for spraying (ejecting) minutely small liquid drops, and other such devices for ejecting liquids besides ink, are also acceptable. Here, drop refers to the state in which a liquid is ejected from a liquid ejection device, and includes granular shape, teardrop shape, or filiform shape having a tail. Here, the liquid can be any material that can be ejected from a liquid ejection device including, for example, substances in the liquid phase, liquid bodies of high or low viscosity, sols, gel water, or other fluid bodies such as inorganic solvents, organic solvents, solutions, liquid resins, and liquid metals (molten metals), or the like. The liquid not only includes liquids containing a single state of a substance, but can also include those containing particles of functional materials composed of solids, such as pigments, metal powders, or the like, dissolved, dispersed, or admixed in a medium. Ink, liquid crystals, and the like are typical examples of liquids. The aforedescribed inks include ordinary water based inks and oil based inks, as well as various types of liquid compositions such as gel inks, hot-melt inks, and the like. Included among liquid ejection devices are, for example, devices that eject liquids including materials such as electrode materials or coloring mater in dispersed or dissolved form, for use in the manufacture of liquid crystal displays, EL (electroluminescence) displays, field emission displays, color filters, and the like. Also included among liquid ejection devices are devices for ejecting bioorganic compounds for use in biochip manufacture; devices for ejecting specimen liquids and for use as a precision pipettes; textile printing devices; microdispensers; devices for pinpoint ejection of lubricants into precision instruments such as clocks or cameras; devices for ejecting solutions of ultraviolet-curing resins or other transparent resins onto substrates for the purpose of forming very small semi-spherical lenses (optical lenses) for use in optical communication elements or the like; devices for ejecting acid, alkali, or other etchant solutions for etching substrates; and the like. Additionally, powders such as toner are also acceptable as the fluid.

During setting of the ejection timing, the first reference patterns SP1 are not essential, and it is merely necessary to be able to compare the first adjustment patterns RP1 with reference positions. During setting of the adjustment pixel distribution, the second reference patterns SP2 are not essential, and it is merely necessary to be able to compare the second adjustment patterns RP2 with reference positions. It is preferable for the minimum unit of dot formation position settable through setting of the ejection timing as in "PTS adjustment" to be smaller than the pixel pitch in the main scanning direction serving as the unit of adjustment in "pixel displacement." However, this is not limiting. As shall be apparent, the basic operations and effects discussed above can be obtained with devices, methods, programs, adjustment patterns, and the like composed exclusively of constituent elements according to the independent claims, without any constituent elements according to the dependent claims.

As described above, according to various aspects of the invention it is possible to provide a technique for improving positional accuracy in the direction of relative movement of dots formed by a fluid ejection device in which a plurality of nozzle groups included in a direction of relative movement of a head section include a plurality of nozzles in the direction of relative movement. It is also possible to achieve the invention through mutual substitution, combination, or modification of the configurations disclosed in the embodiments and modified examples discussed above; and it is moreover possible to work the invention through mutual substitution, combination, or modification of the configurations disclosed in the embodiments and modified examples discussed above, together with known art. Consequently, the invention is not limited to the embodiments and modified examples discussed above, and also includes configurations arrived at through mutual substitution, combination, or modification of the configurations disclosed in the embodiments and modified examples discussed above, together with known art.

What is claimed is:

1. A dot formation positioning device for a fluid ejection device including a relative movement unit for bringing about relative movement between a recording medium and a head furnished with a plurality of nozzles to eject fluid from the plurality of nozzles in accordance with raster data with the plurality of nozzles including a plurality of nozzle groups in the direction of the relative movement, and the nozzle groups including a plurality of nozzles in the direction of the relative movement, the dot formation positioning device comprising:

a nozzle group timing setting unit configured to set an ejection timing for dots formed by each of the nozzle groups to undergo position adjustment in the direction of the relative movement;

an adjustment pixel setting unit configured to adjust a distribution of adjustment pixels for dots formed by each of the nozzles in the nozzle groups to undergo position adjustment in the direction of the relative movement; and a timing control unit configured to perform control to eject fluid in accordance with both the raster data generated on the basis of the distribution of the adjustment pixels set by the adjustment pixel setting unit and of the ejection timing set by the nozzle group timing setting unit.

2. The dot formation positioning device according to claim 1, wherein the smallest unit in which a dot formation position is adjustable by the nozzle group timing setting unit is smaller than a pitch of the pixels constituting the adjusted raster data, in the direction of the relative movement.

3. The dot formation positioning device according to claim 2, wherein the nozzle group timing setting unit sets the ejection timing for each of the outbound path and return path in the direction of the relative movement; and the adjustment pixel setting unit sets the adjustment pixel distributions for each the outbound path and return path in the direction of the relative movement.

4. The dot formation positioning device according to claim 3, wherein the nozzle group timing setting unit is provided with a first adjustment pattern forming unit for forming a first adjustment pattern in order to adjust the ejection timing, and a timing setting reception unit for receiving the ejection timing setting; and the adjustment pixel setting unit is provided with a second adjustment pattern forming unit for forming a second adjustment pattern in order to adjust the adjustment pixel distribution, and a distribution setting reception unit for receiving the adjustment pixel distribution.

5. The dot formation positioning device according to claim 4, wherein the fluid ejection device is capable of forming dots on the recording medium in a plurality of dot formation modes relating to dot formation; and the first adjustment pattern forming unit forms the first adjustment pattern by a nozzle group for ejecting fluid of a color according to the dot formation mode.

6. The dot formation positioning device according to claim 1, wherein nozzles for ejecting fluid of the same color are present in the first nozzle group and the second nozzle group among the plurality of nozzle groups.

7. A fluid ejection device incorporating the dot formation positioning device according to claim 1.

8. A dot formation positioning method for a device including a relative movement unit for bringing about relative movement between a recording medium and a head furnished with a plurality of nozzles to eject fluid from the plurality of nozzles in accordance with raster data with the plurality of nozzles including a plurality of nozzle groups in the direction of the relative movement, and the nozzle groups including a plurality of nozzles in the direction of the relative movement, the dot formation positioning method comprising:

setting an ejection timing for adjusting, in the direction of the relative movement, the positions of dots formed by each of the nozzle groups;

adjusting a distribution of adjustment pixels for adjusting, in the direction of the relative movement, the positions of dots formed by each of the nozzles in the nozzle groups; and ejecting fluid in accordance with both the raster data generated on the basis of the distribution of the adjustment pixels set by the adjusting of the distribution of the adjustment pixels, and the ejection timing set by the setting of the ejection timing.

9. A non-transitory computer readable medium having a program for a device stored thereon, with the device having a relative movement unit for bringing about relative movement between a recording medium and a head furnished with a plurality of nozzles to eject fluid from the plurality of nozzles in accordance with raster data with the plurality of nozzles including a plurality of nozzle groups in the direction of the relative movement and the nozzle groups including a plurality of nozzles in the direction of the relative movement, the program prompting a computer to carry out:

a function for setting an ejection timing for adjusting, in the direction of the relative movement, the positions of dots formed by each of the nozzle groups;

a function for adjusting a distribution of adjustment pixels for adjusting, in the direction of the relative movement, the positions of dots formed by each of the nozzles in the nozzle groups; and a function for ejecting fluid in accordance with both the raster data generated on the basis of the distribution of the adjustment pixels set by the function for adjusting the distribution of the adjustment pixels and the ejection timing set by the function for setting the election timing.

* * * * *